US011940250B2

(12) United States Patent
Woodcock et al.

(10) Patent No.: US 11,940,250 B2
(45) Date of Patent: Mar. 26, 2024

(54) TARGET SUPPORT, SYSTEM AND METHOD

(71) Applicants: Robert Woodcock, Dickinson, TX (US); Lindsay Quebe, Texas City, TX (US)

(72) Inventors: Robert Woodcock, Dickinson, TX (US); Lindsay Quebe, Texas City, TX (US)

( * ) Notice: Subject to any disclaimer, the term of this patent is extended or adjusted under 35 U.S.C. 154(b) by 490 days.

(21) Appl. No.: 17/386,216

(22) Filed: Jul. 27, 2021

(65) Prior Publication Data

US 2021/0356238 A1 Nov. 18, 2021

Related U.S. Application Data

(62) Division of application No. 15/931,381, filed on May 13, 2020, now abandoned.

(60) Provisional application No. 62/847,817, filed on May 14, 2019.

(51) Int. Cl.
*F41J 1/10* (2006.01)

(52) U.S. Cl.
CPC ..... *F41J 1/10* (2013.01)

(58) Field of Classification Search
CPC ..... F41J 1/10; F41J 3/0061; F41J 3/00; F41J 3/0004
USPC ..... 156/278
See application file for complete search history.

(56) References Cited

U.S. PATENT DOCUMENTS

| | | | |
|---|---|---|---|
| 402,112 | A | 4/1889 | Sterick |
| 1,218,398 | A | 3/1917 | Gurtov |
| 2,812,947 | A | 11/1957 | Fatzinger et al. |
| 3,088,738 | A | 5/1963 | Meyer |
| 3,163,418 | A | 12/1964 | Myers |
| 3,280,499 | A | 10/1966 | Studen |
| 4,054,288 | A | 10/1977 | Perrine, Sr. |
| 4,066,261 | A | 1/1978 | Stewart |
| 4,203,600 | A | 5/1980 | Brown |
| 4,239,236 | A | 12/1980 | Parham et al. |
| 4,373,733 | A | 2/1983 | Smith, Jr. |
| 4,477,082 | A | 10/1984 | Mckenzie |
| 4,565,376 | A | 1/1986 | Croll |
| 4,597,574 | A | 7/1986 | Wolfe |
| 4,630,832 | A | 12/1986 | Swanson |
| 4,643,434 | A | 2/1987 | Carlin |
| 4,657,261 | A | 4/1987 | Saunders |
| 4,773,653 | A | 9/1988 | Unverzagt |
| 5,145,133 | A | 9/1992 | France |
| 5,308,084 | A | 5/1994 | Morrell |
| 5,503,403 | A | 4/1996 | Morrell |
| 5,649,708 | A | 7/1997 | Podlesny |

(Continued)

FOREIGN PATENT DOCUMENTS

| | | |
|---|---|---|
| GB | 2403161 | 12/2004 |

OTHER PUBLICATIONS

Sportman's Guide, Mckenzie Aim Rite Layered Foam Bear, https://www.sportsmansguide.com/product/index/mckenzie-aim-rite-layered-foam-bear-target?a=373284, South St. Paul, MN, U.S.A.

(Continued)

*Primary Examiner* — James D Sells
(74) *Attorney, Agent, or Firm* — The Compton Law Firm, P.C.; Scott D. Compton

(57) ABSTRACT

The present disclosure is directed to a target support system. The target support system includes a support that is operationally configured to hold one or more projectile targets.

20 Claims, 22 Drawing Sheets

(56) References Cited

U.S. PATENT DOCUMENTS

| | | | |
|---|---|---|---|
| 6,068,261 | A | 5/2000 | Nettle |
| 6,254,100 | B1 | 7/2001 | Rinehart |
| 6,435,512 | B1 | 8/2002 | Beckwith, Sr. |
| 6,491,303 | B1 | 12/2002 | Huston |
| 6,543,778 | B2 | 4/2003 | Baker |
| 6,550,773 | B2 | 4/2003 | McKenzie et al. |
| 6,575,469 | B2 | 6/2003 | Love |
| 6,966,557 | B2 | 11/2005 | Kirk |
| 6,983,939 | B2 | 1/2006 | Pulkrabek |
| 7,070,185 | B2 | 7/2006 | Pulkrabek |
| 7,258,345 | B2 | 8/2007 | Anderson, Jr. |
| 7,293,776 | B2 | 11/2007 | Fenwick |
| 7,380,796 | B1 | 6/2008 | Hinton |
| 7,434,810 | B2 | 10/2008 | DeMille |
| 7,455,298 | B1 | 11/2008 | Nettle |
| 7,475,880 | B2 | 1/2009 | Bosik |
| 7,744,090 | B1 | 6/2010 | Nettle |
| 8,720,896 | B2 | 5/2014 | Matthis |
| 8,757,626 | B2 | 6/2014 | Acker |
| 8,757,627 | B1 | 6/2014 | Sedlacek |
| 8,771,107 | B1 | 7/2014 | Ayala |
| 8,876,114 | B2 | 11/2014 | Morrell |
| 8,910,944 | B2 | 12/2014 | Mason, III |
| 9,568,286 | B1 | 2/2017 | Carrillo Fuentevilla et al. |
| 9,958,239 | B1 | 5/2018 | Snell et al. |
| 10,113,841 | B2 | 10/2018 | Foley |
| 10,378,864 | B2 | 8/2019 | Soukos |
| 10,520,283 | B2 | 12/2019 | Behnk, Jr. |
| 10,809,041 | B1 | 10/2020 | Weigel |
| 2002/0151387 | A1 | 10/2002 | Henson |
| 2003/0008110 | A1 | 1/2003 | Hsu |
| 2004/0108659 | A1 | 6/2004 | Pulkrabek |
| 2004/0140623 | A1 | 7/2004 | Pulkrabek |
| 2005/0204696 | A1 | 9/2005 | Hall |
| 2007/0029733 | A1 | 2/2007 | Anderson |
| 2007/0290446 | A1 | 12/2007 | Amick |
| 2008/0054570 | A1 | 3/2008 | Potterfield et al. |
| 2008/0185786 | A1 | 8/2008 | Loveland |
| 2010/0015452 | A1 | 1/2010 | Helton |
| 2011/0024986 | A1 | 2/2011 | Walker |
| 2011/0233870 | A1 | 9/2011 | Oh |
| 2013/0249168 | A1 | 9/2013 | Kepple |
| 2013/0270772 | A1 | 10/2013 | McGovern |
| 2014/0042700 | A1 | 2/2014 | Baron |
| 2014/0091190 | A1 | 4/2014 | Argo |
| 2014/0091527 | A1 | 4/2014 | Schneider |
| 2015/0253115 | A1 | 9/2015 | Hartcraft |
| 2016/0016060 | A1 | 1/2016 | Goldwitz |
| 2016/0176175 | A1 | 6/2016 | Strauss |
| 2016/0298942 | A1 | 10/2016 | Skinner |
| 2017/0184377 | A1 | 6/2017 | Carrillo Fuentevilla et al. |
| 2018/0066924 | A1 | 3/2018 | Miller |
| 2018/0321018 | A1* | 11/2018 | Wilson ..... F41J 13/02 |
| 2019/0143188 | A1 | 5/2019 | Moran |

OTHER PUBLICATIONS

First Shot Targets, Steel Targets, Coyote with 4" Kill Zone Flash Indicator, http://www.firstshottargets.com/index.php?route=product/product&product_id=76, Lakewood, CO, U.S.A.

Lancaster Archery Supply, Bowtree Block/Cube Target Stand, http://www.lancasterarchery.com/bowtree-block-cube-target-stand.html, Lancaster, PA, U.S.A.

Wuhan Welldone Laser Co., Ltd., New design archery foam target Dice type EXPE archery shooting game target, Alibaba, https://www.alibaba.com/product-detail/New-design-archery-foam-target-Dice_62416061177.html?spm=a2700.galleryofferlist.0.0.48e13c93099XxD&bypass=true, Hangzhou, Zhejiang, China.

Bulldog Targets, RangeDog Archery Target With Outdoor Stand, https://bulldogtargets.com/products/rangedog-archery-target-with-outdoor-stand?variant=13622045835299, Winnipeg, Manitoba, Canada.

* cited by examiner

TARGET SUPPORT, SYSTEM AND METHOD

CROSS-REFERENCE TO RELATED APPLICATIONS

The present application is a divisional application of U.S. patent application Ser. No. 15/931,381, filed on May 13, 2020, which is entitled to the benefit of the filing date of the prior-filed U.S. Provisional Patent Application No. 62/847,817, filed on May 14, 2019, the content of which is hereby incorporated by reference in its entirety.

STATEMENT REGARDING FEDERALLY SPONSORED RESEARCH OR DEVELOPMENT

Not applicable.

BACKGROUND OF THE DISCLOSURE

1. Field of the Invention

The application relates generally to targets including archery targets.

2. Background Art

Various targets are commercially available for enthusiasts of firearm shooting, archery and other aiming activities. Some targets are offered as a single or one-piece item. In other instances, targets are provided with a target holder portion that serves as a base structural support or frame for holding a replaceable aiming target portion. Some targets used by hunters are provided with a structural support portion in the form of a three-dimensional animal and a removable aiming target held by the support portion at one or more desired locations for aiming purposes. In other instances, a whole three-dimensional animal type structure may serve as a target. In the above examples, the target and/or target holder is often formed of molded foam having a shape resembling that of a game animal, e.g., a bear, deer, elk. Although offered as "life-size," many game animal targets are actually smaller than the size of the animal as encountered in the wild, which works against proper aiming or targeting of the animal for future real world encounters. While other three-dimensional animal-simulating targets may be more closely provided as "life-size," such targets are often costly to manufacturer according to their three-dimensional shape and are relatively expensive for consumers to purchase. Also, the molded foam used to construct the target and/or target holder may be subject to destruction over time resulting in additional replacement costs.

Still other hunting type targets are provided with overlays that simulate the perimeter shape and appearance of particular game animals and have openings there through representing areas of vital organs to be impacted by projectiles. Replaceable targets are typically located at the openings for targeting purposes. Such overlays are typically constructed from one or more solid materials such as wood, plastic, metal, or one or more lightweight materials such as foam and/or lightweight plastic. In certain instances, the materials of construction are sometimes provided as hard or solid resulting in structural damage to certain projectiles upon impact, e.g., arrows, spears, darts, etc. In other instances, the materials of construction are soft or too lightweight whereby one or more projectiles, e.g., arrows, spears, darts, etc., pass through the overlay subjecting persons and objects located behind the overlay to being struck by such projectiles.

Overcoming the above shortcomings is desired.

SUMMARY OF THE DISCLOSURE

The present disclosure is directed to a target system, including (1) one or more targets and (2) a support for the one or more targets including a main body having a front surface, a rear surface, one or more openings there through, one or more rear surface items including one or more landing surfaces operationally configured to hold the one or more targets at the one or more openings; wherein the main body includes an inner section and an outer section covering the inner section.

The present disclosure is also directed to a support for holding a projectile target, including (1) a main body having (a) an outlay design; (b) a front surface having an appearance corresponding to the outlay design; (c) an opening located along the main body according to the outlay design and front surface appearance of the main body; and (d) a rear surface; and (2) a frame type member secured to the rear surface of the main body and operationally configured to hold a projectile target at the opening, the frame type member including one or more elongated members further operable as backing members disposed along the rear surface according to the outlay design.

The present disclosure is also directed to a method of making a support for a projectile target, comprising (1) forming a main body of a support including one or more openings in the main body and one or more rear surface items from a single sheet of closed cell extruded polystyrene foam; (2) assembling the main body and one or more rear surface items to form an inner section of the main body; and (3) spraying a coating onto the main body and one or more rear surface items to form an outer section of the main body.

DEFINITIONS USED IN THE DISCLOSURE

Figure 1:
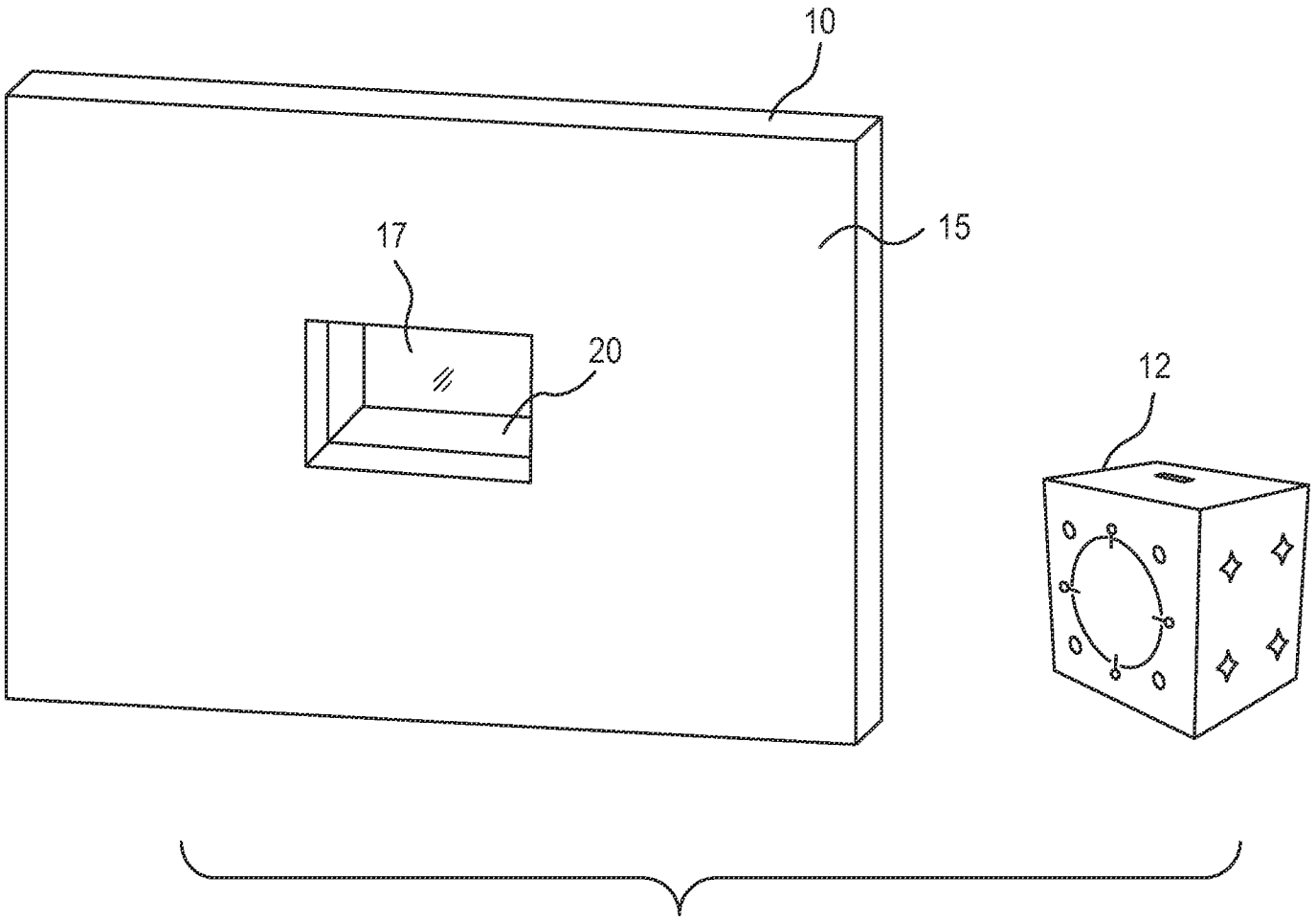
FIG. 1 is a simplified front perspective view of an embodiment of the system of the present disclosure.

The term "at least one", "one or more", and "one or a plurality" mean one thing or more than one thing with no limit on the exact number; these three terms may be used interchangeably within this application. For example, at least one device means one or more devices or one device and a plurality of devices.

The term "about" means that a value of a given quantity is within ±20% of the stated value. In other embodiments, the value is within ±15% of the stated value. In other embodiments, the value is within ±10% of the stated value. In other embodiments, the value is within ±7.5% of the stated value. In other embodiments, the value is within ±5% of the stated value. In other embodiments, the value is within ±2.5% of the stated value. In other embodiments, the value is within ±1% of the stated value.

The term "substantially" or "essentially" means that a value of a given quantity is within ±10% of the stated value. In other embodiments, the value is within ±7.5% of the stated value. In other embodiments, the value is within ±5% of the stated value. In other embodiments, the value is within ±2.5% of the stated value. In other embodiments, the value is within ±1% of the stated value. In other embodiments, the value is within ±0.5% of the stated value. In other embodiments, the value is within ±0.1% of the stated value.

DETAILED DESCRIPTION OF THE DISCLOSURE

For the purposes of promoting an understanding of the principles of the disclosure, reference is now made to the embodiments illustrated in the drawings and particular language will be used to describe the same. It is understood that no limitation of the scope of the claimed subject matter is intended by way of the disclosure. As understood by one skilled in the art to which the present disclosure relates, various changes and modifications of the principles as described and illustrated are herein contemplated.

It is to be understood that the present disclosure is not limited to particular embodiments. It is also to be understood that the terminology used herein is for the purpose of describing particular embodiments only, and is not intended to be limiting. As used in this specification and the appended claims, the term "arrow" may refer to one or more types of archery arrows according to the type of point provided. For purposes of this disclosure and as understood by persons of ordinary skill in the art of archery, exemplary arrow points include broadhead points, bullet points, field points, grabbing points, blunt points, and fishing points. In regard to firearm target shooting, the phrase "AR500" refers to AR500 steel plates commonly used as firearm targets. The initials "CNC" in regard to a CNC machine or CNC router machine stands for "Computer Numerical Control." As understood by the skilled artisan, the term "R-value" is commonly used in the United States of America ("U.S.A.") as a measure of a material's thermal resistance and "RSI" refers to R-value Systeme International, which is a measurement of a material's thermal resistance commonly used outside of the U.S.A. Herein, the phrases "fluid conduit" and "fluid line" may be used interchangeably. Herein, the phrase "fluid proportioner" refers to a dispensing system that receives separate fluid components, mixes the components in a predetermined ratio and then dispenses the components as an activated fluid composition. The phrase "plural component proportioning system" may be used interchangeably with the phrase "fluid proportioner." In reference to game animals, the term "realistic" means simulating the actual perimeter size and shape of a game animal when the game animal is situated in a particular desired orientation for being struck by one or more projectiles. The term "realistic" may further include simulating the physical look and appearance of a game animal.

In one aspect, the disclosure provides a system for use in a plurality of shooting and aiming endeavors. Non-limiting examples of shooting and aiming endeavors include firearm shooting, archery targeting, crossbow targeting, paintball gun shooting, sling and shot targeting, spear targeting, bean bag tossing, ball throwing, tennis, dart throwing, blow gun targeting, and combinations thereof.

In another aspect, the disclosure provides a target support for holding one or more projectile targets, the target support being shaped and sized to represent or otherwise depict a game animal in a realistic fashion for aiming practice purposes.

In another aspect, the disclosure provides a system for assisting in target practice across a plurality of shooting and aiming endeavors including a target support and one or more removable projectile targets to be located at corresponding openings of the target support.

In another aspect, the disclosure provides a target support that may be constructed from one or more rigid materials and one or more flexible materials. The target support may include one or more outer coatings configured to cure on the surface of rigid and flexible materials.

In another aspect, the disclosure provides a support for a third party projectile target including, but not necessarily limited to a third party archery target constructed from polystyrene foam with an outer coating comprised of a polyurea and/or polyurethane spray coating applied to the polystyrene foam at a thickness effective to maintain the structural integrity of the polystyrene foam therein.

FIG. 1 provides a simplified illustration of an embodiment of a target system of the present disclosure. In this embodiment, the system includes a first member 10 (also referred to herein as a "main member" or "main body") and one or more second members 12 (also referred to herein as a "target" or "projectile target") removably paired with the first member 10 for system operation. Suitably, the first member 10 is operationally configured to hold or otherwise support one or more second members 12 in a fixed position for targeting purposes. In this embodiment, the first member 10 includes a front surface 15 and a rear surface 18 (see FIG. 2) when oriented in an upright or substantially upright position, including a vertical position as shown. As further depicted, the first member 10 includes one or more openings 17 there through operationally configured to receive the one or more second members 12. In the embodiment of FIG. 1, the front surface 15 is shown as a planar surface. In another embodiment, the front surface 15 may be provided as a non-planar surface. Although the one or more openings 17 are configured as locations for the one or more second members 12, it is contemplated that one or more openings 17 may be left devoid of corresponding second members 12 during system operation.

The first member 10 may also include one or more items disposed along the rear surface 18 for suitable operation of the first member 10. One exemplary item disposed along the rear surface includes one or more landing surfaces or support members 20 corresponding to the one or more openings 17. In the embodiment of FIG. 1, the one or more support members 20 are disposed along a rear surface 18 of the first member 10 and operationally configured to hold one or more second members 12 at the opening 17 in a fixed position in a manner effective for the one or more second members 12 to act as an aiming target or projectile target at the opening 17. Herein, to hold a second member 12 at an opening 17 may include holding a second member 12 in a mated position within an opening 17 or holding a second member 12 near an opening 17. As discussed herein, a second member 12 may be provided as a removable consumable member to be replaced once the second member 12 is no longer useful as a workable projectile target, i.e., wear and tear to the second member 12. However, it is also contemplated that the first member 10 and one or more second members 12 may be provided as a one-piece construction whereby the first member 10 and one or more second members 12 may be discarded as a single unit once the first member 10 and/or the one or more second members 12 are no longer useful as a workable target due to extended use.

Figure 2:
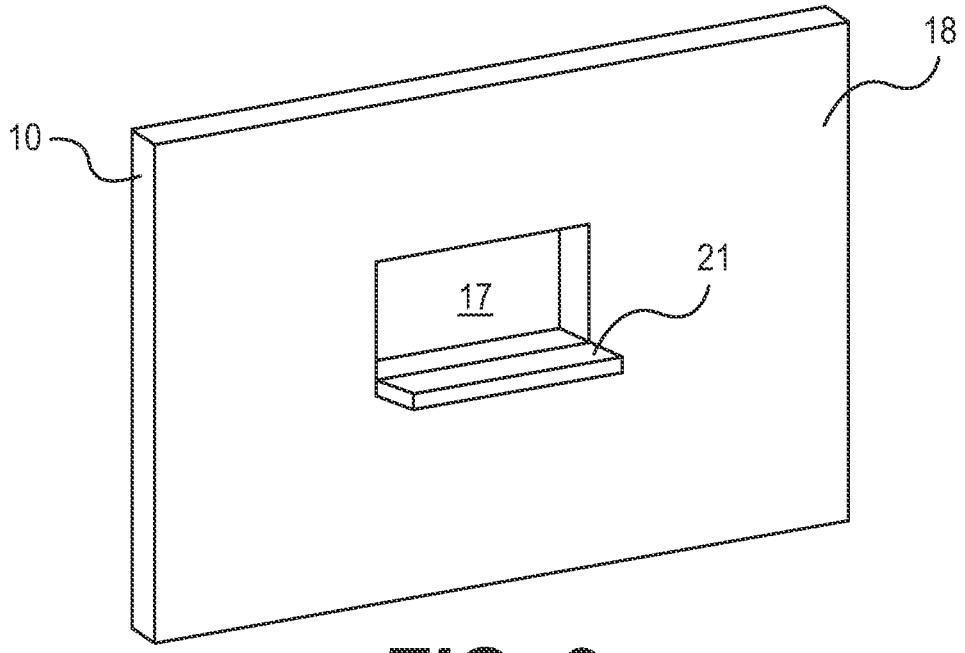
FIG. 2 is a simplified rear perspective view of an embodiment of a first member of the system of the present disclosure.
Figure 3:
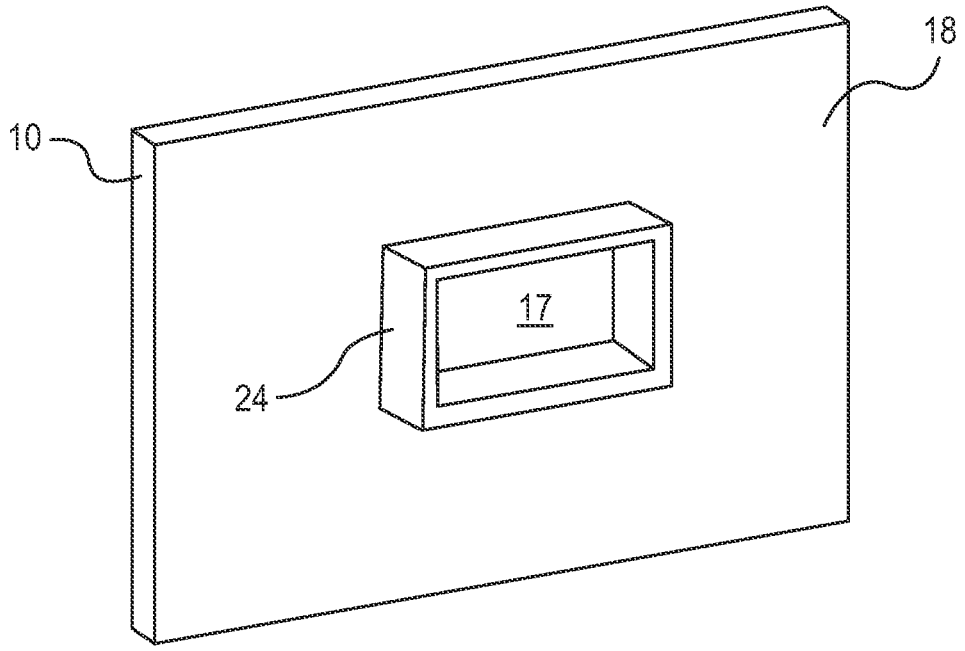
FIG. 3 is a simplified rear perspective view of an embodiment of a first member of the system of the present disclosure.
Figure 4:
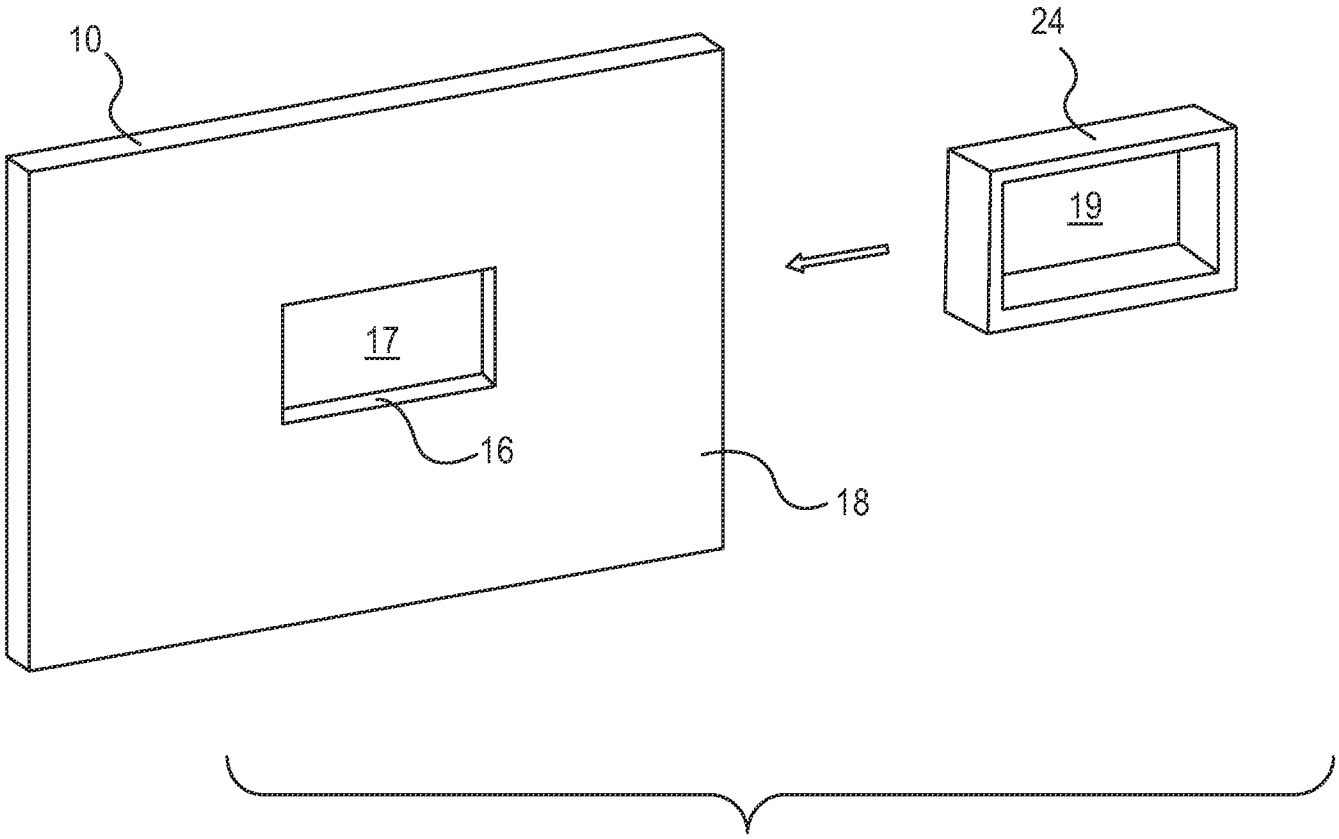
FIG. 4 is a rear exploded perspective view of an embodiment of a first member of the system of the present disclosure.

In one embodiment, a support member 20 may include one or more ledge type members 21 at or near the lower portion of each opening 17 for supporting one or more second members 12 thereon (see FIG. 2). In another embodiment, a support member 20 may include one or more frame type members 24 defining an opening 19 there through, each frame type member 24 being disposed along the perimeter of each opening 17 in a manner effective to support one or more second members 12 therein (see FIGS. 3 and 4). In the embodiments of FIGS. 2-4, the rear surface 18 is shown as a planar type surface wherein a support surface of the support member 20 may be defined by a plane perpendicular to the plane of the rear surface 18. In another embodiment, the rear surface 18 and/or the support surface of the support member 20 may be provided as non-planar surfaces.

Figure 5:
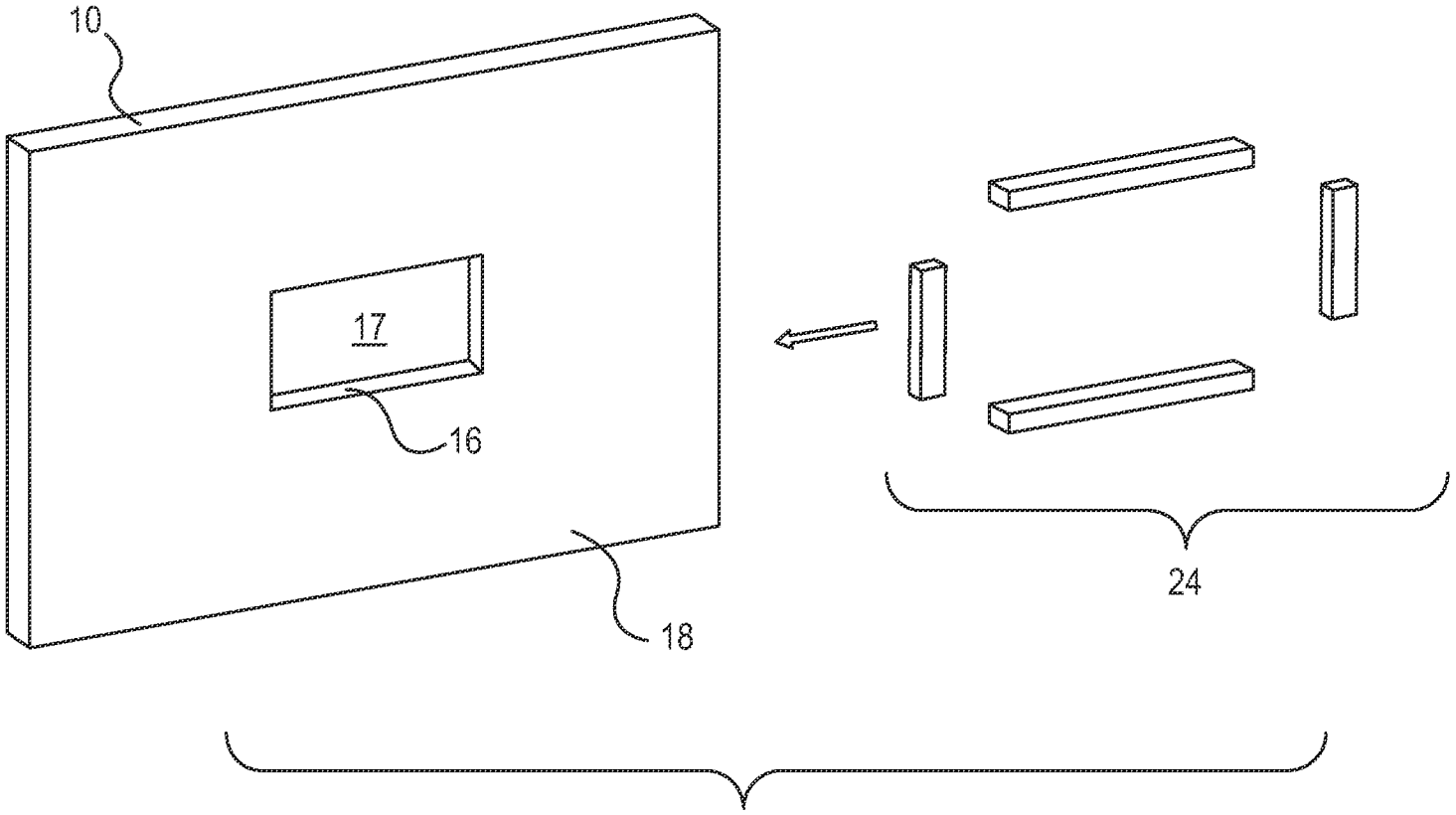
FIG. 5 is a rear exploded perspective view of an embodiment of a first member of the system of the present disclosure.

In one embodiment, a first member 10 and one or more support members 20 may be provided as a one-piece construction. In another embodiment, a first member 10 and one or more support members 20 may be provided as separate component parts to be secured together to form a one-piece member. Referring to FIG. 4, in an embodiment including a separate support member 20 having one or more frame type members 24, the one or more frame type members 24 may be provided in a one-piece configuration as shown securable to the rear surface 18 and/or secured to the perimeter inner surface 16 defining each of the one or more openings 17. In another embodiment as shown in FIG. 5, the one or more frame type members 24 may be comprised of an assembly of individual parts securable to the rear surface 18 and/or secured to the perimeter inner surface 16.

Figure 6:
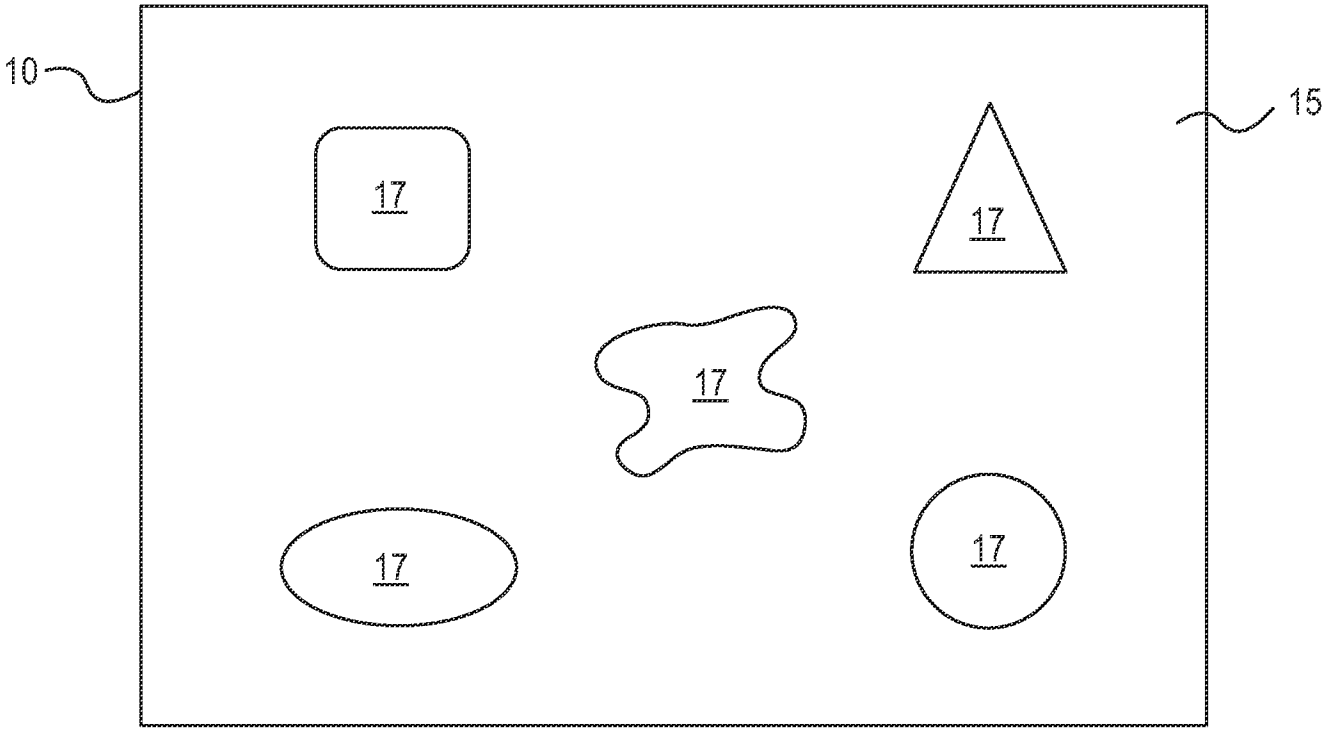
FIG. 6 is a front elevational view of an embodiment of a first member of the system of the present disclosure.

The dimensions of the one or more openings 17 may be determined according to the dimensions of one or more particular second members 12 to be used as part of the system. In the embodiments of FIGS. 1-5, the one or more openings 17 are depicted in a rectangular configuration. As such, a corresponding frame type member 24 may include a rectangular configuration with the same or substantially similar inner dimensions as the one or more openings 17 of the first member 10 and second member 12 to be set within the frame type member 24. Other opening 17 configurations are also contemplated for use according to user preference and/or according to the size and shape of a desired second member 12 and/or the outlay design of the first member 10 and/or the front surface appearance of the first member 10. Non-limiting examples of opening 17 configurations include rectangular openings with rounded corners, non-rectangular multi-sided openings, circular openings, oval openings, and irregular shaped openings (see FIG. 6). Accordingly, any frame type member 24 provided as part of the first member 10 may include a size and shape the same or substantially similar as its corresponding opening 17 whereby the frame type member 24 is disposed at or near the perimeter inner surface 16 defining the corresponding opening 17.

In one embodiment, the one or more second members 12 may include projectile targets provided as part of the present system. In such an embodiment, the size and shape of the one or more second members 12 may be manufactured for operating with one or more particular first members 10 and one or more openings disposed along the one or more first members 10. In another embodiment, one or more second members 12 may include third-party marksman projectile targets of one or more sizes and/or shapes corresponding to one or more openings 17 formed in the first member 10 and the corresponding frame type members 24 if and when included as part of the system. Without limiting the invention, one suitable third-party marksman projectile target may include an archery target commercially available from the following exemplary sources: Morrel Targets, Morrel Manufacturing, Alma, Arkansas, U.S.A.; Bulldog Archery Targets, Winnipeg, Manitoba, Canada; Block® Targets, FeraDyne Outdoors, L.L.C., Superior, Wisconsin, U.S.A. The skilled artisan will appreciate that the above list of commercial sources of archery targets is not meant to be exhaustive. Another exemplary third-party marksman projectile target may include a firearm target including, but not necessarily limited to an AR500 target commercially available from ShootSteel.com, Ramsey, Minnesota, U.S.A; and AR500 Target Solutions, Rice Lake, Wisconsin, U.S.A.

Figure 7:
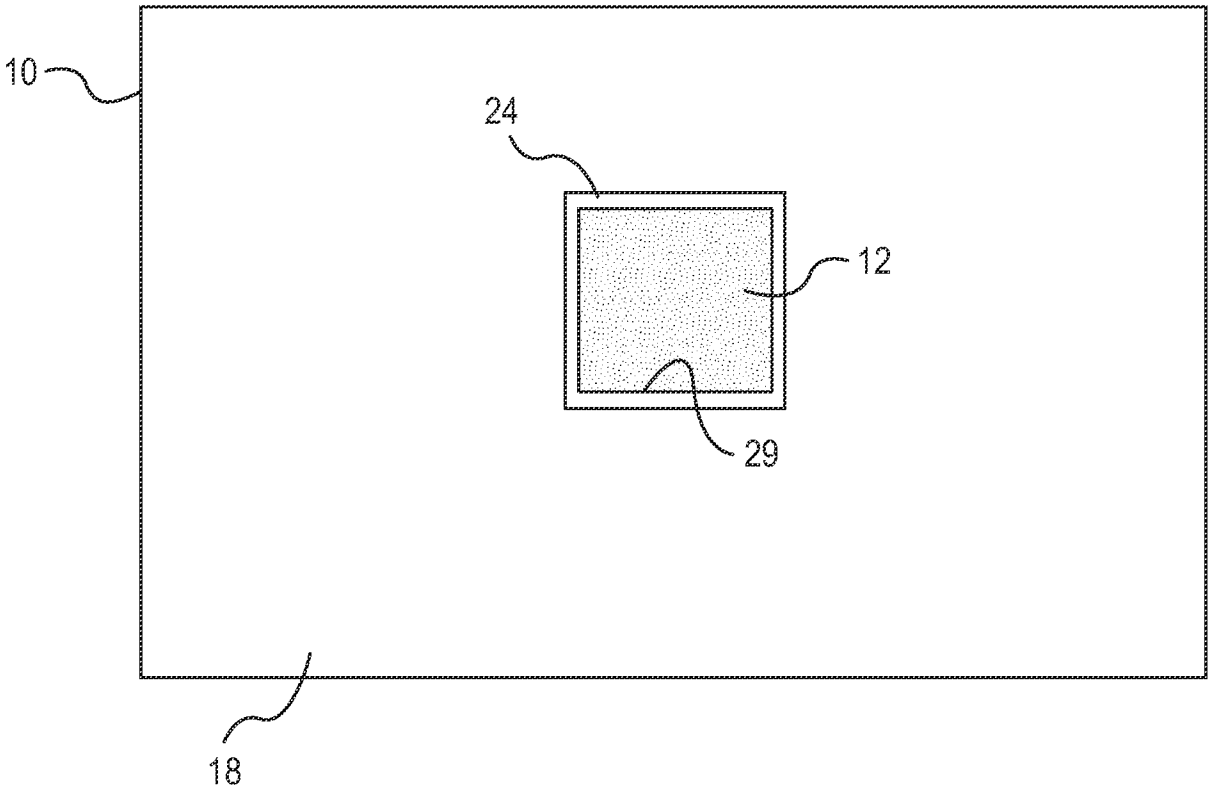
FIG. 7 is a rear elevational view of an embodiment of a first member of the system of the present disclosure.
Figure 8:
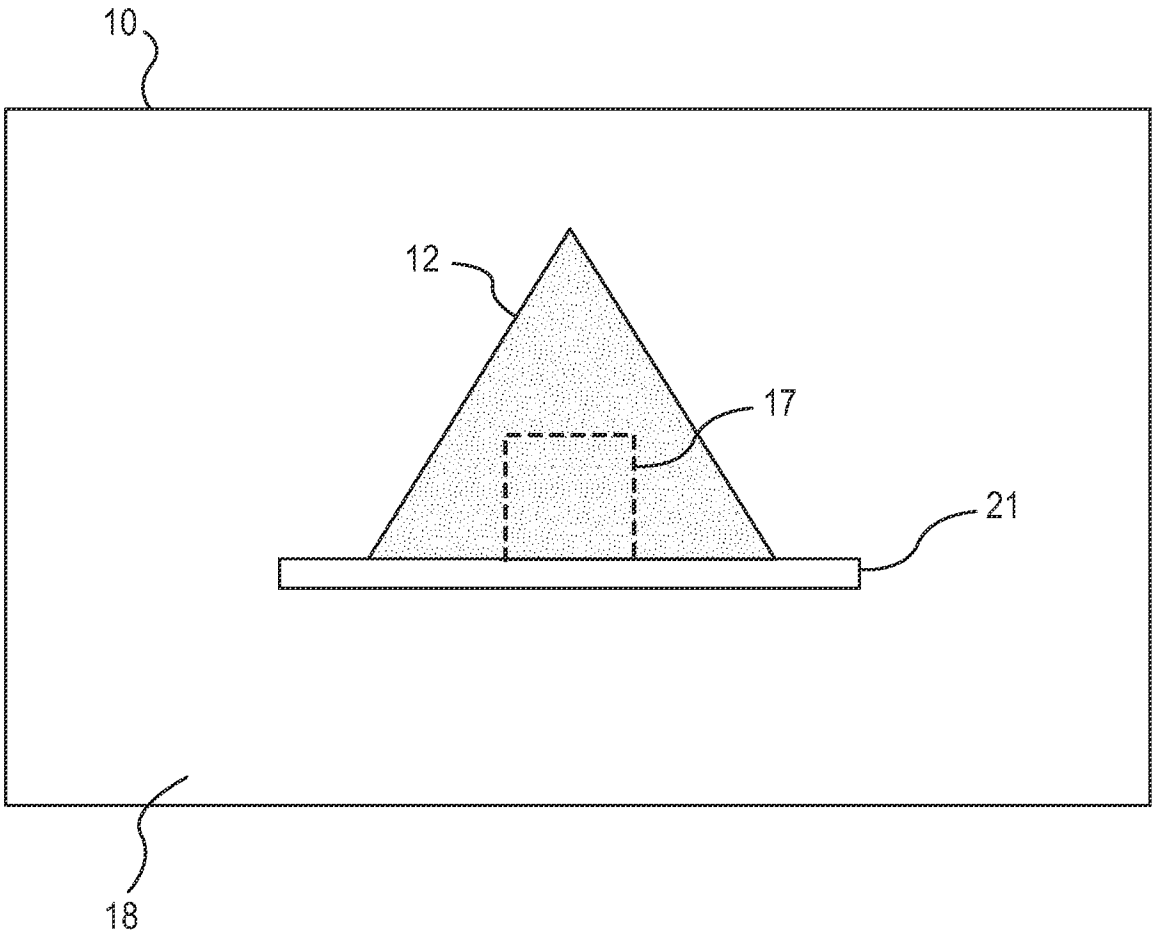
FIG. 8 is a rear elevational view of an embodiment of a system of the present disclosure.

As shown in FIG. 7, one frame type member 24 may include an inner surface 29 providing a snug type fit for at least part of a second member 12 where at least part of the outer surface of the second member 12, i.e., the top, bottom, right and left sides of the second member 12, lies in abutment with the inner surface 29 of the frame type member 24, i.e., the uppermost inner surface, the lowermost inner surface, the opposing inner side surfaces. In one embodiment, at least part of the second member 12 may lie in abutment with at least part of the perimeter inner surface 16 of an opening 17 and at least part of the second member 12 may lie in abutment with at least part of the inner surface 29 of a corresponding frame type member 24. For example, at least part of a second member 12 may rest atop the perimeter inner surface 16 and a least part of the second member 12 may rest atop the lowermost inner surface of a corresponding frame type member 24. In another embodiment, the inner dimensions of the frame type member 24 may be greater than the outer dimensions of a corresponding second member 12. In an embodiment where a support member 20 is provided as a ledge type member 21, the second member 12 may be larger dimensionally than a corresponding opening 17 of the first member 10. Accordingly, the shape of the second member 12 may vary from the shape of the opening 17 and still provide a target surface disposed across the entire opening 17 (see the triangular shaped second member 12 disposed across the rectangular opening 17 in FIG. 8).

Figure 9:
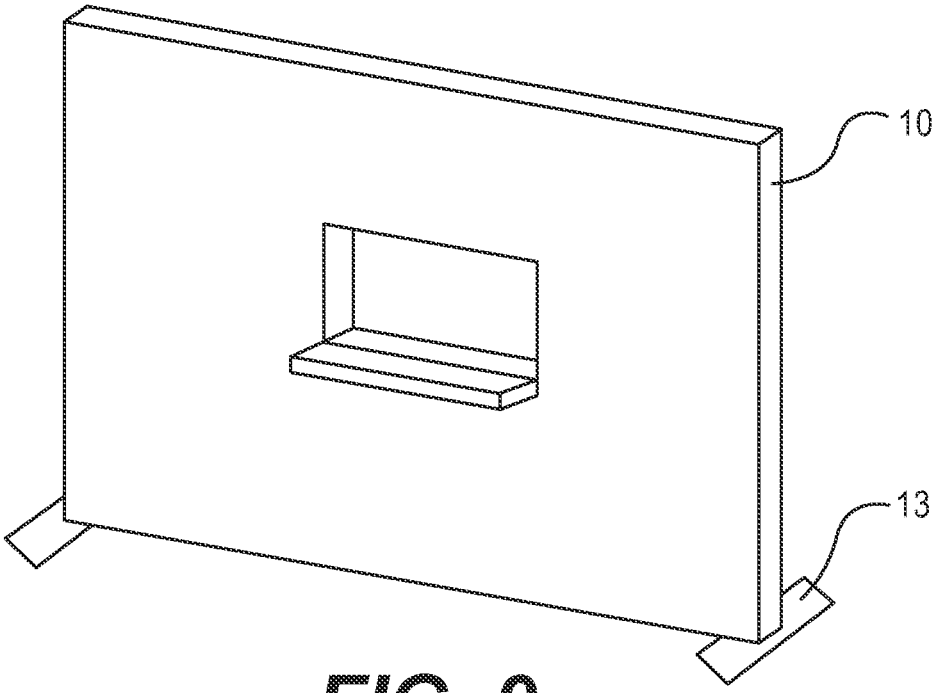
FIG. 9 is a front perspective view of an embodiment of a first member of the present disclosure.
Figure 10:
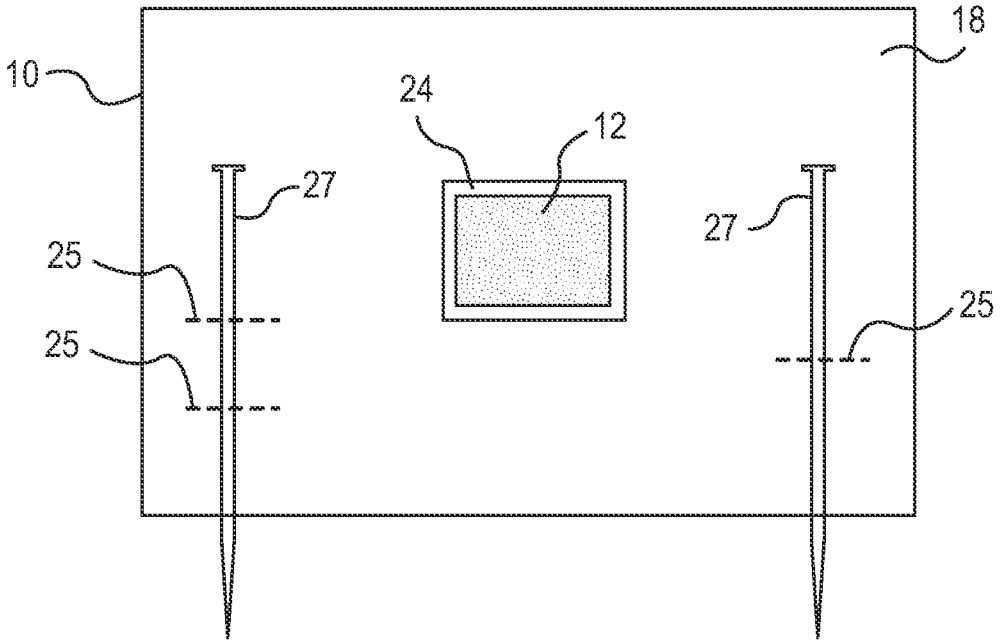
FIG. 10 is a rear elevational view of an embodiment of the system of the present disclosure.

Suitably, the first member 10 may be held in an upright or substantially upright fixed position during use as desired. In one embodiment, the lowermost portion of the first member 10 may be set in a dugout portion of earth or ground 5 and held in a fixed position therein. In another embodiment, wall type structures, e.g., roofed structures, fences, gates, and/or other items such as large rocks, logs, vehicles, farm equipment, trees, bushes, posts, and/or other objects may be used to hold a first member 10 in an upright or substantially upright fixed position. In one particular embodiment as shown in FIG. 9, the first member 10 may include one or more bases 13 operationally configured to maintain a first member 10 in an upright fixed position—shown here as a vertical fixed position. In another embodiment as shown in FIG. 10, a first member 10 may include one or more stake holders 25 disposed along the rear surface 18 and/or front surface 15, the one or more stake holders 25 having openings 26 for receiving stake members 27 there through. Without limiting the invention, suitable stake members 27 of the present system may include, but are not limited to plastic spikes, metal spikes, wooden spikes, piping, rebar, T-posts, spiral or corkscrew ground base anchors, other items that are ground 5 penetrable, and combinations thereof.

Figure 11:
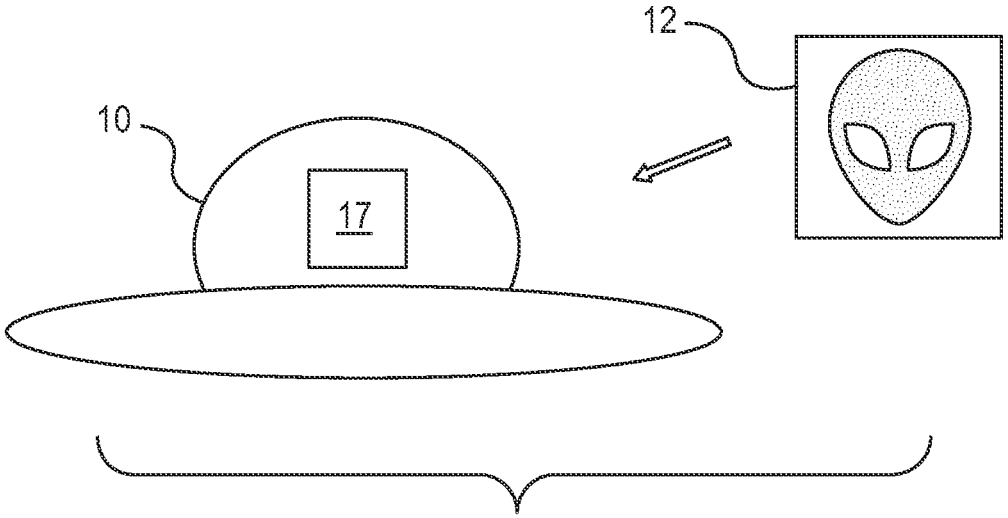
FIG. 11 is a front view of an embodiment of the system of the present disclosure.
Figure 12:
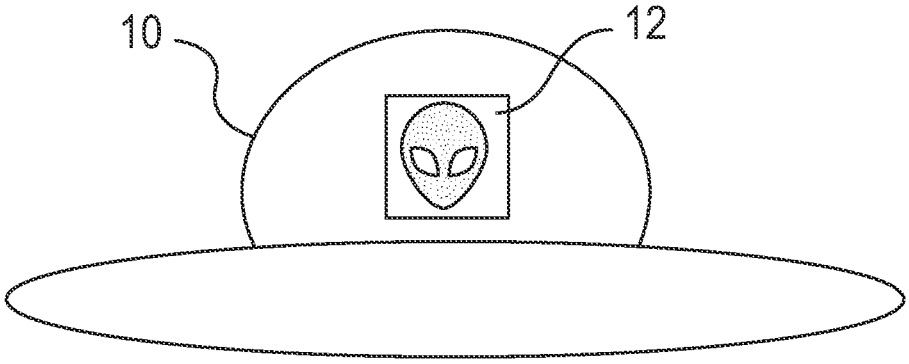
FIG. 12 is a front elevational view of the system of FIG. 11 in an operating position.

For purposes of this disclosure, the first member 10 may be built to scale, i.e., the first member 10 may be provided in any size and/or shape as desired or as otherwise required for one or more operations. As shown in FIGS. 1-10, the first member 10 may be provided having a rectangular perimeter shape. In another embodiment, the first member 10 may include a non-rectangular perimeter shape, e.g., a multi-sided shape, a circular shape, an oval shape, an irregular shape. In another embodiment, the first member 10 may include a perimeter shape replicating an animate or inanimate object, life size or otherwise as may be desired or otherwise required for one or more aiming or targeting practices. As one non-limiting example, a first member 10 may include a shape of a flying saucer with an opening 17 operationally configured for operation with a second member 12 having a surface depiction of a space alien thereon for aiming purposes (see FIGS. 11 and 12). In addition, the front surface 15 of a first member 10 may include indicia such as an arrangement of colors, patterns, and designs visually displaying the look and appearance of a particular animate or inanimate object. The present system may also be used for military training applications wherein a first member 10 may be provided in the size, shape and indicia of enemy combatants and items such as machinery, e.g., vehicles, tanks, planes, as well as structures such as buildings, military towers, tents, and the like.

Figure 13:
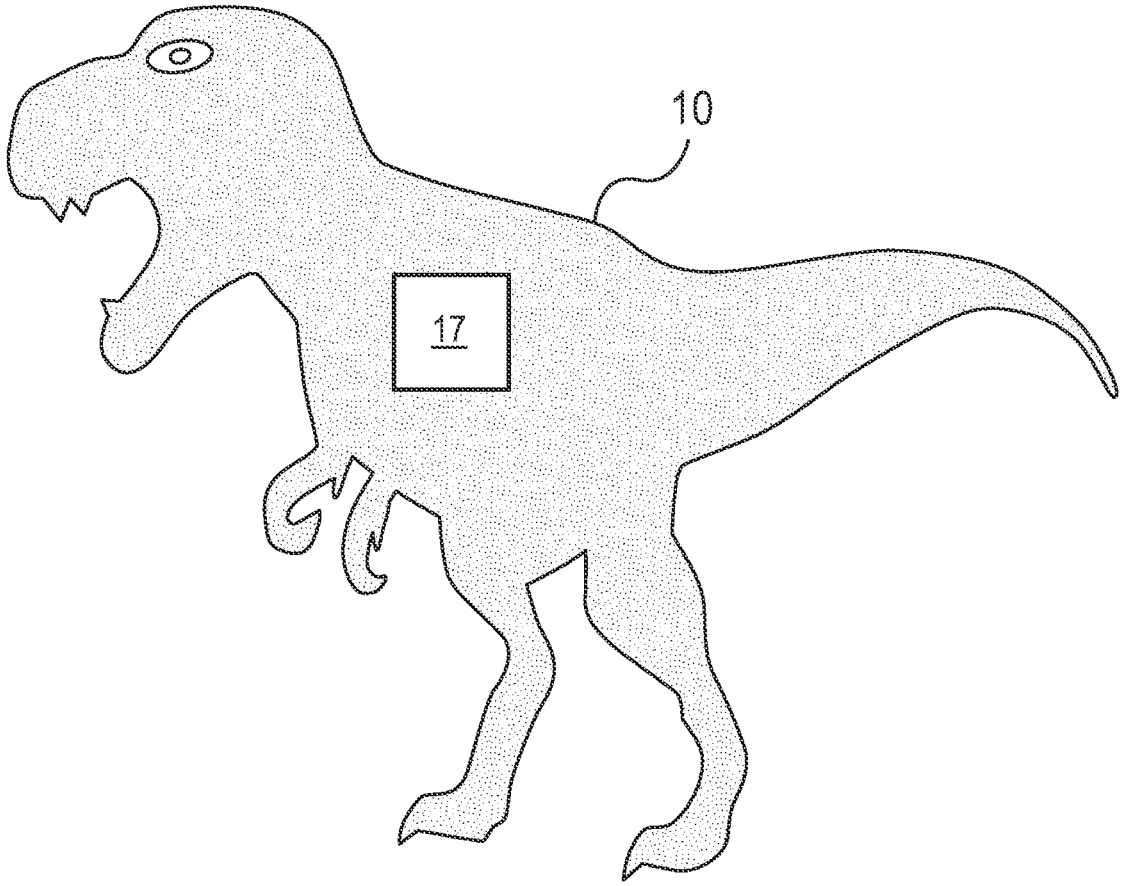
FIG. 13 is a front elevational view of an embodiment of a first member of the present disclosure.

In another embodiment, the first member 10 may include a perimeter shape and/or a front surface 15 with indicia to provide a fictional character, e.g., cartoon characters, comic book characters, or other fictional entities such as ghosts, vampires, elves, giants, the grim reaper, wizards, dragons, and any other character or entity as may be left to the user's imagination. The first member 10 may also include a perimeter shape and/or a front surface 15 with indicia to provide a non-fictional character, e.g., knights, gladiators, mammoths, and any other character or entity as may be left to a user's imagination (see FIG. 13, which includes a first member 10 with a perimeter in the shape and surface details of a dinosaur as recognized by the general public as well as persons of ordinary skill in the art of paleontology).

Figure 14:
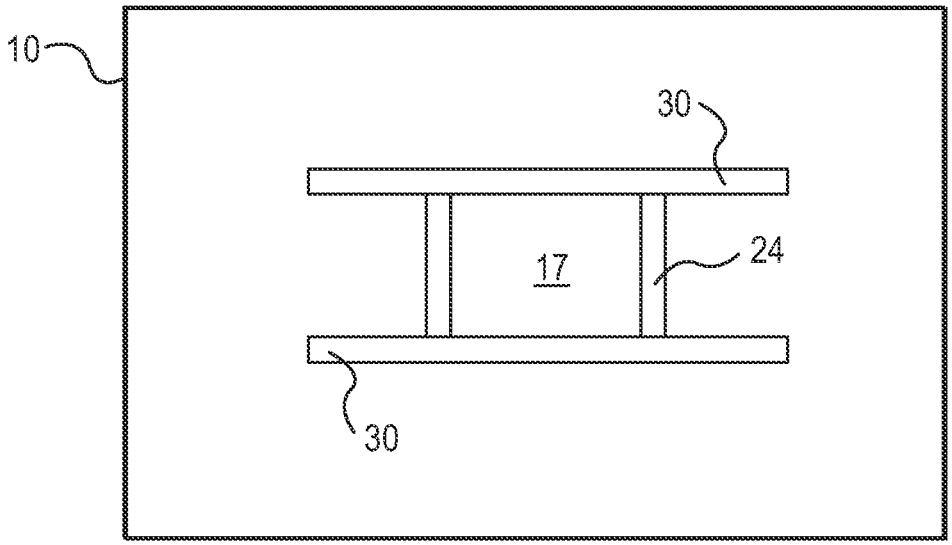
FIG. 14 is a rear elevational view of an embodiment of a first member of the present disclosure.
Figure 15:
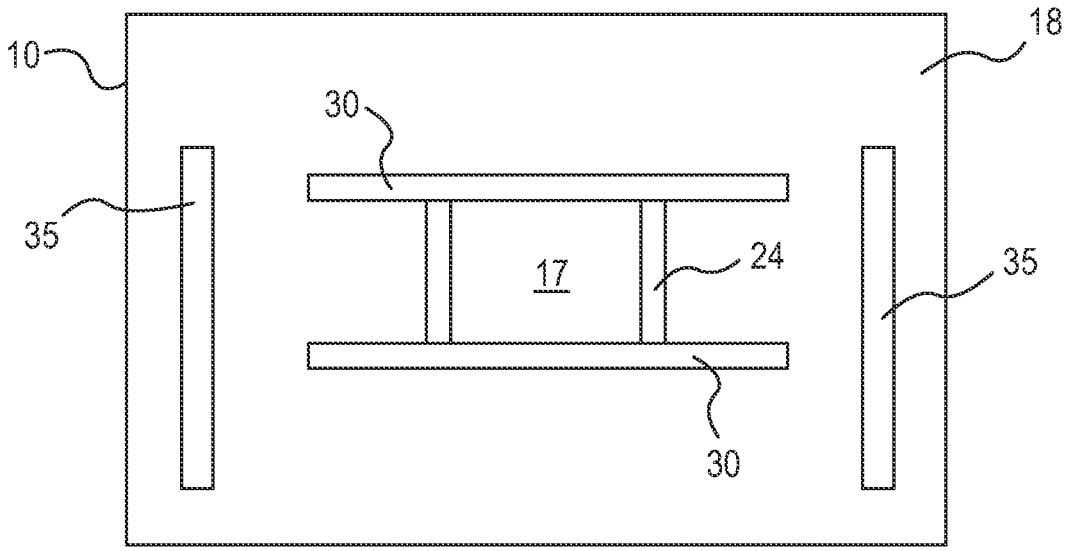
FIG. 15 is a rear elevational view of an embodiment of a first member of the present disclosure.
Figure 16:
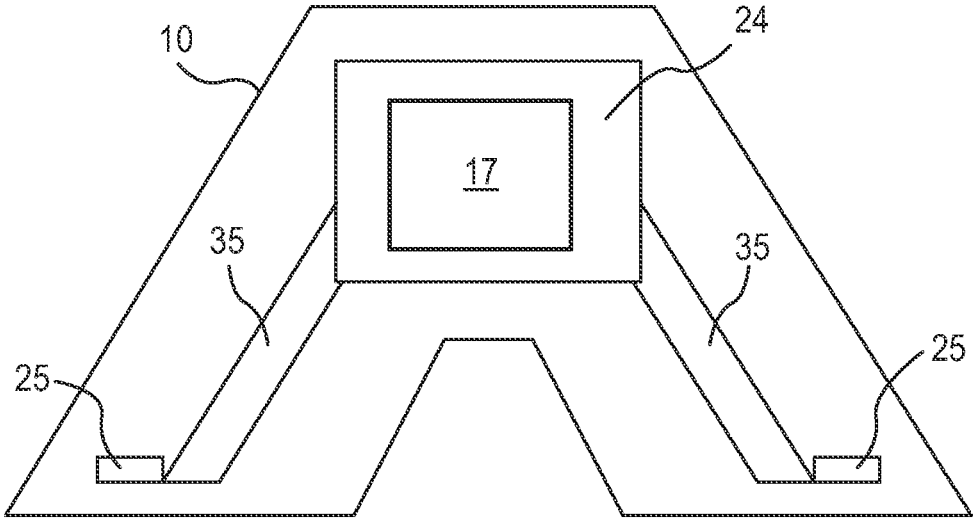
FIG. 16 is a rear elevational view of an embodiment of a first member of the present disclosure.
Figure 17:
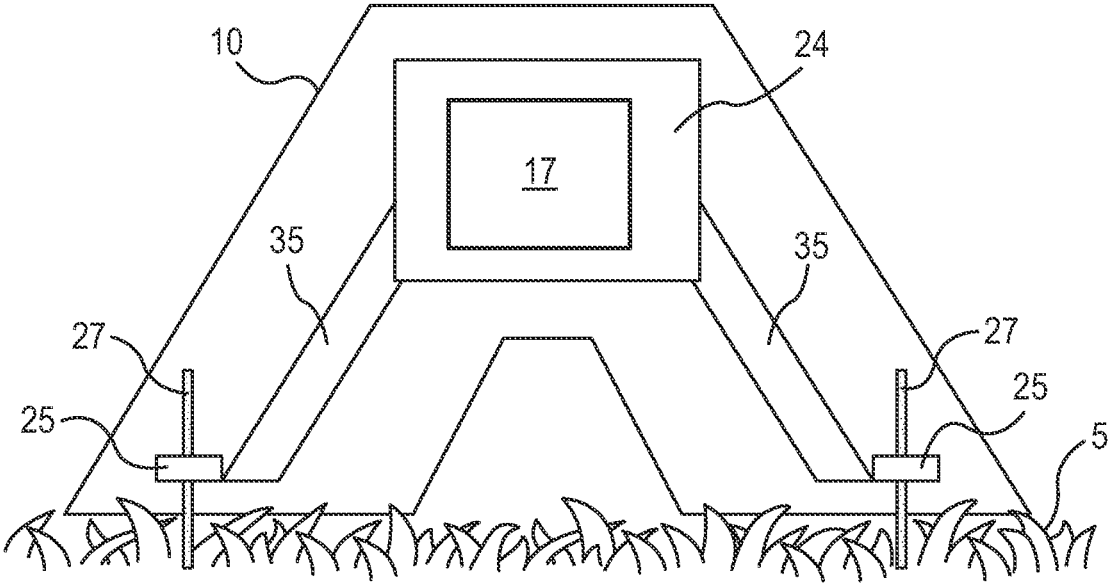
FIG. 17 is a rear elevational view of the first member of FIG. 16 including stake members set in the ground 5 in a manner effective to hold the first member in an upright position.

In another embodiment, one or more frame type members 24 may further act as structural reinforcements providing added structural strength to a first member 10. As shown in FIG. 14, one frame type member 24 may include one or more elongated sections 30 extending out from the rectangular frame type member 24 in one or more desired directions along the rear surface 18 of the first member 10, the one or more elongated sections 30 being operationally configured to provide structural strength to the first member 10. In another embodiment, the first member 10 may include one or more additional reinforcements or backing members 35 including, for example, one or more backing members 35 disposed along the rear surface 18 operationally configured to provide added structural strength to the first member 10 (see FIG. 15). As shown in FIG. 15, the one or more backing members 35 may be set apart from the frame type member 24 (or ledge type member 21). In another embodiment, one or more backing members 35 may contact or be connected to the frame type member 24 or ledge type member 21. In another embodiment, one or more backing members 35 may be disposed along the surface of the first member 10 according to the shape or configuration of the first member 10. For example, FIG. 16 depicts a first member 10 shaped similar as the letter "A" whereby the each leg of the A-shaped first member 10 includes a backing member 35 disposed directionally along at least part of the length of each leg of the first member 10. In this embodiment, the one or more backing members 35 may include one or more stake holders 25 (also see FIG. 17). For purposes of this disclosure, the frame type member 24, one or more backing members 35 and one or more stake holders 25 may be referred to herein as "rear side members" although one or more of the frame type member 24, one or more backing members 35 and one or more stake holders 25 may be located on a front surface 15 of a first member 10 in another embodiment of the first member 10.

In yet another embodiment, the first member 10 may include a perimeter shape resembling a particular animal, e.g., a game animal, as such terminology is understood by persons of ordinary skill in the art of hunting. For purposes of this disclosure, game animals may include animals originating from any of the seven continents. Common North American game animals include, but are not necessarily limited to bears, deer, elk, sheep, moose, oxen, caribou, wild boar, wolves, coyotes, and varieties of each. Common African game animals include, but are not necessarily limited to lions, leopards, rhinoceroses, elephants, Cape buffalo, wildebeests, impalas, zebras, antelope, warthogs, elephants, hippopotamuses, blesboks, giraffe, ostriches, and varieties of each. As such, in one embodiment a first member 10 may include an outer perimeter configured in the shape or likeness of a particular game animal on a scale the same or similar as a life size representation of such animal effective to provide accuracy and more realistic practice opportunities to users of the present system. Moreover, the front surface 15 may include one or more details or finishing details such as (1) one or more anatomical features, e.g., hair, eyes, claws, teeth, indications of muscle separation, rib cage, hooves, and/or (2) coloring details in order to fashion the first member 10 in a life like representation of a particular animal. The hair applied to the first member 10 may include actual hide for the animal of the first member 10, faux hide, synthetic fibers, human hair, and combinations thereof. Suitable eyes may simply be painted onto the front surface 15 or additional materials may be attached to the front surface 15 to act as a realistic eye(s) for the animal of the first member 10. Suitable materials may include, but are not necessarily limited to plastics, glass, metals, ceramic material (e.g., porcelain), and combinations thereof. Exemplary glass eyes may include taxidermy eyes. Exemplary claws and teeth may include actual claws and/or teeth removed from an animal, taxidermy claws and/or teeth, life like claws and teeth constructed from wood, ceramic material (e.g., porcelain), plastic, glass, metal, and combinations thereof.

Figure 18:
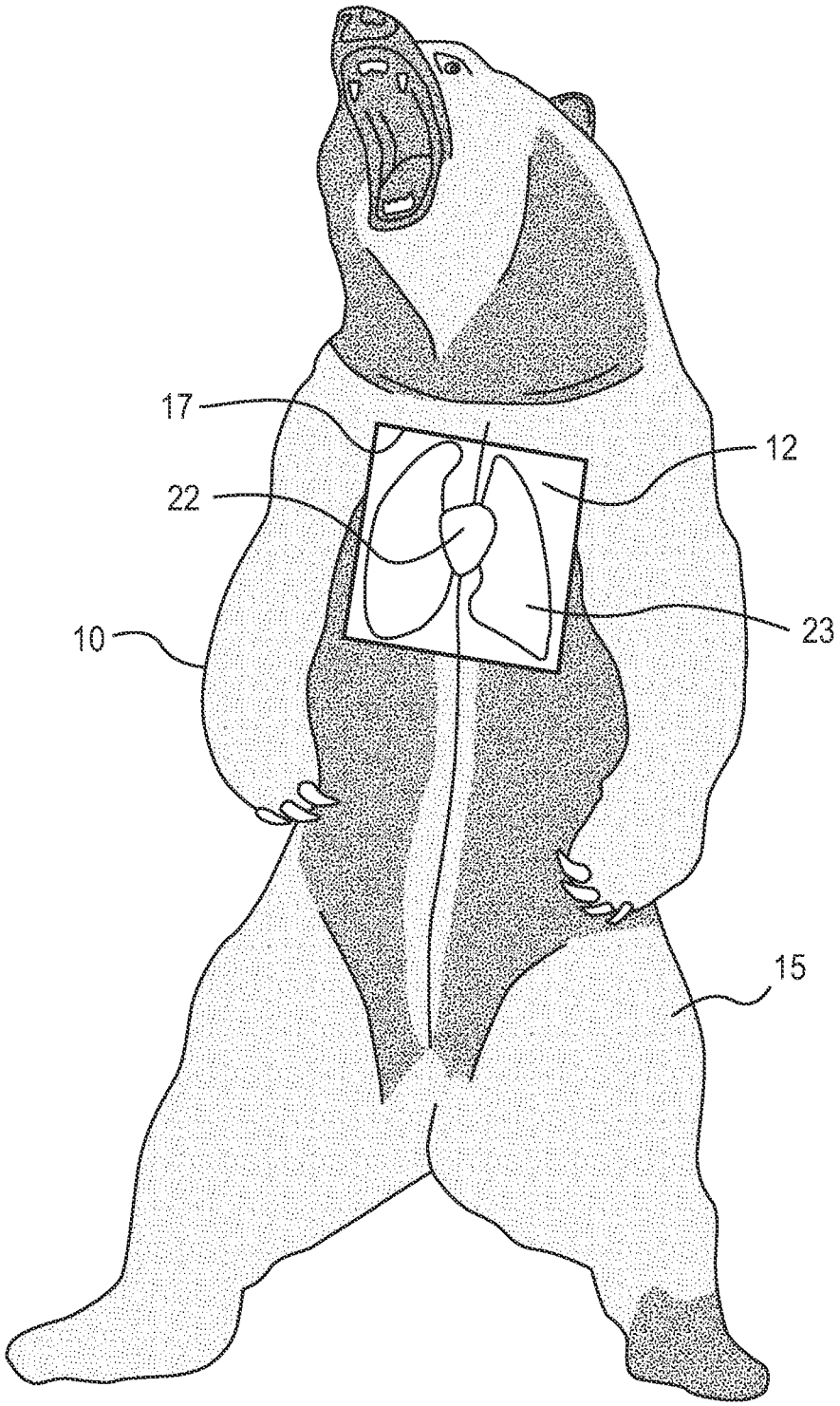
FIG. 18 is a front elevational view of an embodiment of a first member of the present disclosure provided in the appearance of a standing grizzly bear.

Referring to FIG. 18, one exemplary first member 10 for archery and/or firearm purposes may be provided in the size, representative shape, details and coloring of a grizzly bear in an upright or standing position on its hind legs including at least one rectangular opening 17 for use with a second member 12 such as a third-party commercially available archery marksman target device or other target as shown in FIG. 1. In another embodiment, a grizzly bear may be provided standing on all four legs. In the embodiment of FIG. 18, the first member 10 may include dimensions as listed in Table 1 below effective for simulating the realistic appearance of a grizzly bear for purposes of archery and/or firearm target practice:

TABLE 1

| | |
|---|---|
| Height of First Member 10 | 2.44 meters (8.0 feet); |
| Width of First Member 10 | 0.91 meters (3.0 feet); |
| Height of Opening 17 | 0.46 meters (1.5 feet); |
| Width of Opening 17 | 0.46 meters (1.5 feet). |

As shown, the opening 17 may be formed in the first member 10 at a desired location for aiming purposes according to the animal in question. For example, one or more openings 17 may be formed in the first member 10 at locations corresponding to the location of one or more vital organs of the game animal form of the first member 10.

In one embodiment, a second member 12 may be mated with or set adjacent the opening 17 similar as described above. In another embodiment, a second member 12 may be provided having a front target surface comprising one or more colors similar as the corresponding front surface 15 of the first member 10 and/or comprising one or more details effective to provide a realistic appearance of the animal in question, e.g., brown coloring representing the hair coloring and realistic appearance of a grizzly bear, suitable to provide a continuous front surface 15. In addition, the second member 12 may include a layout or pattern on its surface accurately depicting one or more vital organs of the animal in question for targeting purposes, e.g., see the heart 22 and lungs 23 as shown in FIG. 18. In one embodiment, a second member 12 may be manufactured to include a particular color or array of colors and/or one or more vital organs on its front target surface. In another embodiment, a third party archery target may be modified to include a desired color or array of colors and/or one or more vital organs on its front target surface. For example, vital organs may be painted onto the front target surface, screen printed onto the front target surface and/or routed out of the front or forward facing surface of a third party archery target by hand and/or machine. In one particular embodiment, a hand router may be used to form grooves in the front or forward facing surface of a third party archery target representing one or more vital organs. Thereafter, the front or forward facing surface of a third party archery target may be painted or decorated as desired.

Figure 19:
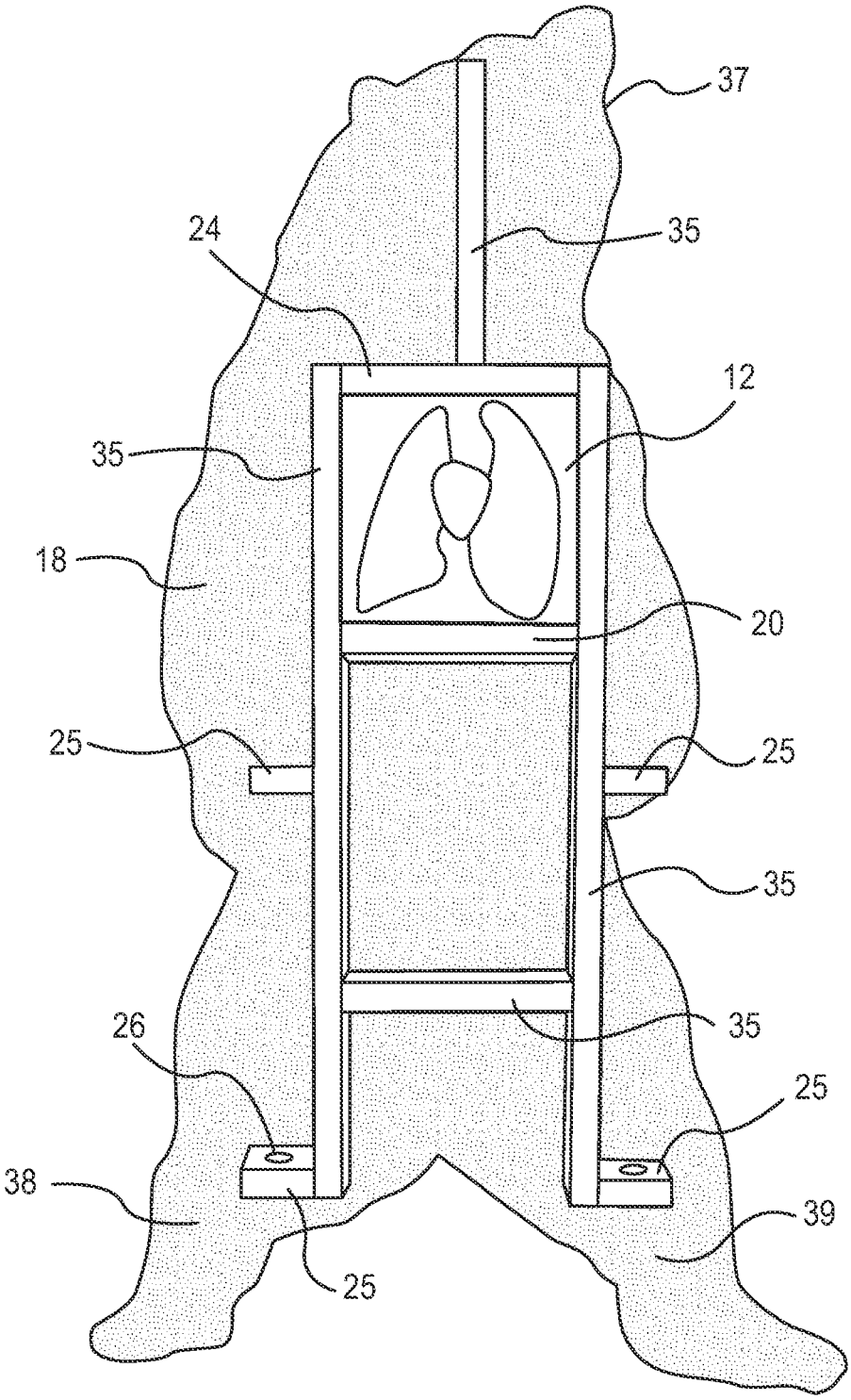
FIG. 19 is a rear elevational view of the first member of FIG. 18.

FIG. 19 depicts the rear surface 18 of the first member 10 of FIG. 18. As shown, the first member 10 includes a frame type member 24 for housing a second member 12 and various backing members 35 disposed across the rear surface 18 according to the perimeter layout of the first member 10. In particular, the first member 10 includes a first backing member 35 extending upward from the frame type member 24 as a structural support for the head region 37 of the grizzly bear shaped first member 10. The first member 10 also includes two opposing parallel backing members 35 extending downward from the upper portion of the frame type member 24 to the areas along the rear surface 18 corresponding to the legs 38, 39 of the grizzly bear including a support member 20 disposed between the parallel backing members 35 forming the bottom side of the frame type member 24 as shown. In this embodiment, the two opposing parallel backing members 35 also operate as the side members of the frame type member 24. In this embodiment, each of the parallel backing members 35 may include a pair of stake holders 25 with openings 26 axially aligned for receiving one or more stake members 27 there through. In another embodiment, one or more stake holders 25 may be secured to the rear surface 18 independent of backing members 35.

Figure 20:
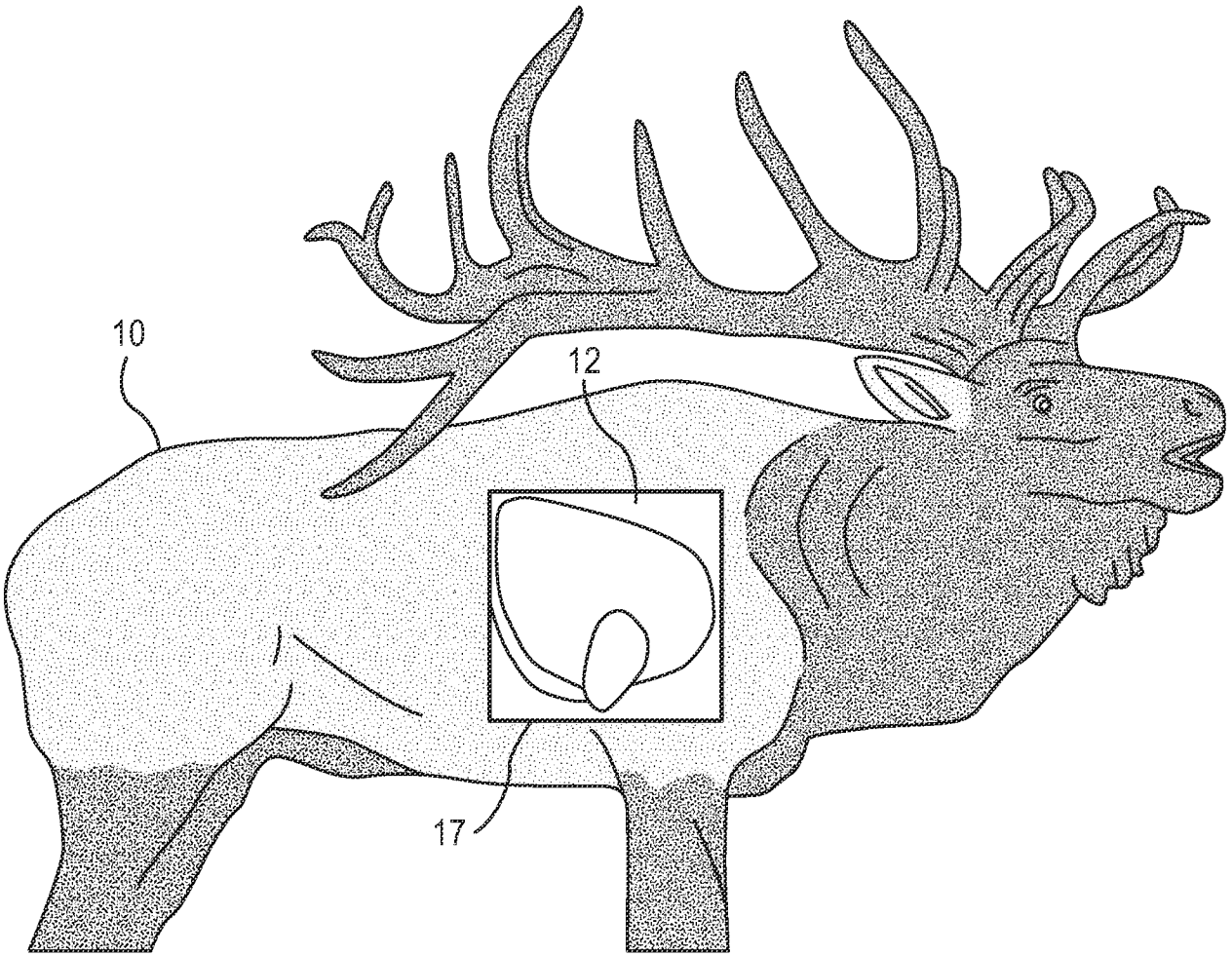
FIG. 20 is a front elevational view of an embodiment of a first member of the present disclosure provided in the appearance of a standing elk.
Figure 21:
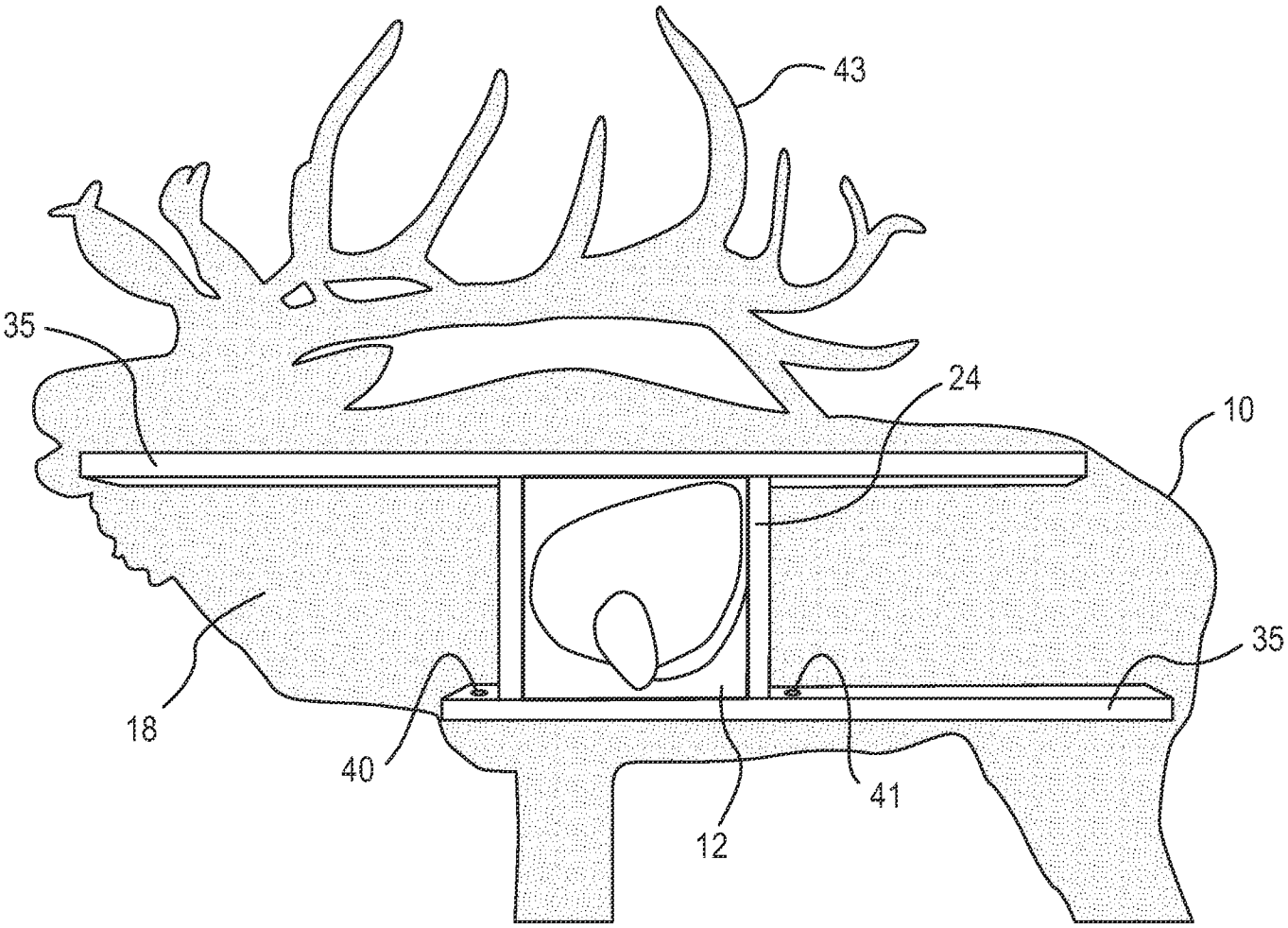
FIG. 21 is a rear elevational view of the first member of FIG. 20.

FIGS. 20 and 21 depict another exemplary game animal styled first member 10 provided in the size, representative shape and coloring of an elk. Similar as the grizzly bear based first member 10 described above, the elk shaped first member 10 may include one or more openings 17 corresponding to the location of one or more vital organs, the one or more openings 17 being operationally configured to receive a corresponding second member 12 including a second member 12 having a color pattern and depiction of one or more vital organs as shown. In addition, the front surface 15 may include multiple colors indicative of the coloring of an elk as encountered in the wild.

Although the elk of FIGS. 20 and 21 is provided in a sideways orientation relative a user of the system, in another embodiment the first member 10 may include the appearance of an elk facing any other conceivable orientation relative a user as desired or as may be ethically allowable according to one or more legislative and/or regulatory bodies. By providing a game animal styled first member 10 in a life size stature, coloring and posture, the realism of the first member 10 benefits a user in regard to his/her marksmanship. In particular, by providing a life like game animal for practice purposes users of the system ideally become accustomed to shooting under realistic appearing conditions thereby allowing a user of the system to train his/her eyes and nervous system to recognize distance and shot placement on a second member 12 of the system to enhance his/her aiming ability for efficient and/or ethical shots on target.

Similar as the grizzly bear embodiment of FIGS. 18 and 19, the first member 10 of the elk as shown in FIG. 21 includes two opposing backing members 35 operationally configures as the top and bottom sides of the frame type member 24. In addition, the backing members 35 are also operationally configured as stake holders—see openings 40, 41 for receiving stake members 27 there through. In another embodiment, one or more additional backing members 35 may be added to the rear surface 18 of the first member 10, e.g., one or more backing members 35 may be disposed along the antlers 43 of the elk.

Without limiting the invention, the first member 10 may be constructed from one or more materials including, but not necessarily limited to materials resistant to chipping, cracking, excessive bending and reshaping as a result of weathering, heat, moisture, other outside mechanical and chemical influences, as well as impacts and forces applied to the first member 10. In an embodiment intended for archery type operations, the first member 10 may include a first body section 45 alone or further include a second body section 47 covering all or a portion of the outer surface of the first body section 45. Herein, the first body section 45 may also be referred to as an "inner section" of the first member 10 and the second body section 47 may also be referred to as an "outer section" of the first member 10.

Suitably, the first member 10 described above is operationally configured as a support for one or more second members 12 and not necessarily operationally configured as a target. However, it is contemplated that the first member 10 may be constructed from one or more materials effective to receive impacts from projectiles in a target like manner. For example, in an embodiment including a first member 10 intended to hold a second member 12 such as an archery target at or near its opening 17, the first member 10 may include a first body section 45 constructed from one or more materials comprising a density effective to (1) stop and retain a tip section of an arrow without the tip section penetrating or otherwise breaking through the rear surface 18 of the first member 10, and (2) maintain the operable shape of the first member 10 without bending, breaking or otherwise deforming although such is not necessarily required for operability of the first member 10. In another embodiment, the first body section 45 may be constructed from one or more materials allowing passage of an arrow completely through the first member 10, e.g., where the first member 10 is to be used in an open area such as an open field, an interior location, against a wall or other barrier, thereby eliminating or minimizing the threat of an arrow traveling out past the first member 10 and striking person(s) and/or object(s).

For archery type operations, one suitable second body section 47 may include an outer skin type configuration formed from one or more layers of solid material(s) and/or one or more layers of one or more coatings, e.g., one or more flowable coatings, covering all or a portion of the first body section 45. In one particular embodiment for archery type operations, the second body section 47 may be comprised of one or more resilient materials effective to completely or at least partially return to its original state or condition once an arrow having penetrated the second body section 47 is removed or otherwise separated from the first member 10.

Exemplary materials of construction of the first body section 45 may include, but are not necessarily limited to polymeric materials, woods, feathers, cork, sand, paper products including recycled paper products, textiles, cotton, coconut fiber, crumb rubber, bamboo infused foam, and combinations thereof. Suitable polymeric materials may include, but are not necessarily limited to foam including, but not necessarily limited to polyethylene foam, polystyrene foam (e.g., extruded polystyrene foam ("XPS"), expanded polystyrene foam ("EPS")), polyurethane foam (e.g., closed-cell foam, open-cell foam), polyester, compressed polyester, polyester fiber fill, synthetic rubbers, and combinations thereof. One suitable type of synthetic rubber includes, but is not necessarily limited to neoprene, e.g., neoprene sheets.

Exemplary materials of construction of the second body section 47 may include, but are not necessarily limited to polyurethane coatings (e.g., hand brush coatings, spray coatings, and combinations thereof), polyurea coatings (e.g., hand brush coatings, spray coatings, and combinations thereof), polyurethane-urea hybrid coatings (e.g., hand brush coatings, spray coatings, and combinations thereof), epoxy coatings, stretch wrap materials, vinyl wrap materials, tapes, rubber coatings, acrylic coatings, paper products, textiles, fiberglass, woven fiberglass tape, and combinations thereof. Suitable rubber coatings may include, but are not necessarily limited to silicone coatings, ethylene propylene diene monomers ("EPDM") coatings, and combinations thereof. Suitable textiles may include, but are not necessarily limited to cotton fabrics, polyester fabrics, canvas, denim, continuous filament basalt (volcano rock) fiber wrap, nylon, ripstop fabrics (e.g., ripstop nylon and ripstop polyester), and combinations thereof.

As stated above, the first member 10 of this disclosure may be built to scale. Accordingly, the first member 10 may include a maximum thickness as desired for workability and/or for ease of transport of the first member 10 based on the one or more materials of construction as may be required for one or more particular operations. The first member 10 may also include a minimum thickness as desired or as otherwise required for one or more particular operations and/or according to the one or more materials of construction of the first member 10. Likewise, the thickness of the second body section 47 may vary as desired or as otherwise required for one or more particular operations. In addition, the proportions of the first body section 45 and the second body section 47 in regard to thickness of the first member 10 may vary according to one or more intended uses of the first member 10. For example, in an embodiment where a first member 10 may serve for both archery and non-penetrable projectile use (e.g., paintball targeting via a paintball gun), the proportion of the second body section 47 may be increased compared to other embodiments of the first member 10, i.e., the second body section 47 may be made thicker, to withstand impacts from projected paintballs traveling at speeds ranging from 73.2-85.3 meters per second (240.0-280.0 feet per second). Without limiting the disclosure, one exemplary first member 10 may include a second body section 47 having a thickness ranging from or about 0.16 cm to or about 1.91 cm (from or about 0.0625 inches or 1/16 inches to or about 0.75 inches or 3/4 inches).

For archery type applications in general, one exemplary first member 10 including a first body section 45 constructed from foam, e.g., polyethylene foam, polystyrene foam, polyurethane foam, may include a first body section 45 with a maximum thickness and a minimum thickness as listed in Table 2:

TABLE 2

| | |
|---|---|
| Maximum Thickness | 10.16 cm (4.0 inches); |
| Minimum Thickness | 5.08 cm (2.0 inches). |

In regard to an archery type first member 10 provided as a life size game animal such as the grizzly bear as shown in FIG. 18 and an elk as shown in FIG. 20 including a first body section 45 constructed from extruded closed cell polystyrene foam and a second body section 47 comprising polyurea spray coating, the first member 10 suitably has a maximum thickness and a minimum thickness as listed in Table 3:

TABLE 3

| | |
|---|---|
| Maximum Thickness | 11.1 cm (4.375 inches or 4.375 inches); |
| Minimum Thickness | 5.24 cm (2.063 inches or 2.063 inches). |

Figure 22:
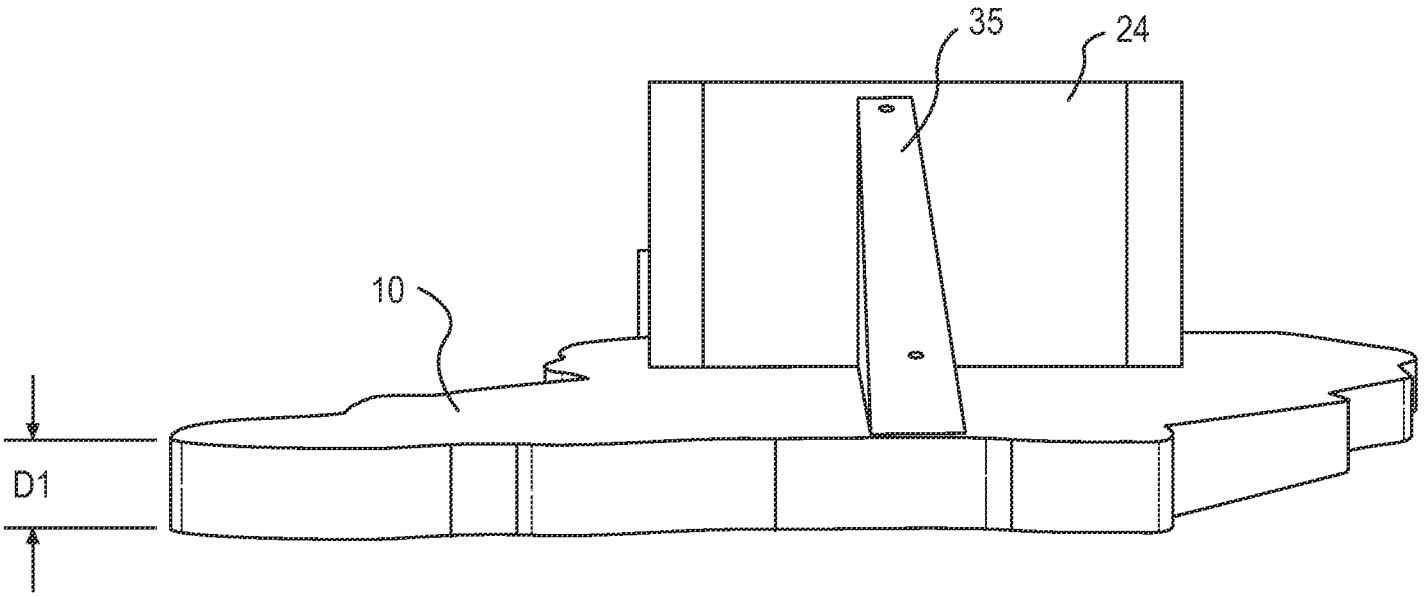
FIG. 22 is a top view of the first member of FIG. 18.

As such, in one exemplary embodiment of an archery type first member 10 wherein the average thickness of the first body section 45 is 5.08 cm (2.0 inches) and the average thickness of the second body section 47 is 0.0625 inches or 1/16 inches, the second body section 47 comprises about three percent of the thickness of the first member 10. In an embodiment of an archery type first member 10 wherein the average thickness of the first body section 45 is 5.08 cm (2.0 inches) and the average thickness of the second body section 47 is 0.281 inches or 9/32 inches, the second body section 47 comprises about twelve percent of the thickness of the first member 10. In an embodiment of an archery type first member 10 wherein the average thickness of the first body section 45 is 5.08 cm (2.0 inches) and the average thickness of the second body section 47 is 0.32 cm (0.125 inches or 1/8 inches), the second body section 47 comprises about six percent of the thickness of the first member 10 (see dimension D1 in FIG. 22).

Persons of ordinary skill in the art will recognize that the thickness of the first member 10 may vary without altering the workability of the first member 10. Persons of ordinary skill in the art will also recognize that an arrow is commonly projected through the air via a bow or crossbow from about 12.2 meters per second up to about 121.9 meters per second (from about 40.0 feet per second up to about 400.00 feet per second) depending on the make/model of the bow, age of person shooting the arrow, the type of arrow used, ambient wind conditions and/or other ambient weather conditions. As stated above, the first member 10 is operationally configured as a support for one or more second members 12 and not necessarily operationally configured as a target. However, a person of ordinary skill in the art will appreciate that it is plausible that a first member 10 may be constructed according to an anticipated arrow velocity and/or arrow(s) design and/or type of arrow(s) including the materials of construction of an arrow tip section to be used with the system effective to stop and retain such arrow(s) in the first member 10 without the tip section of an arrow traveling out past the rear surface 18 in the event that such arrow misses a targeted second member 12.

Persons of ordinary skill in the art will also recognize that the first member 10 may have a total weight according to the one or more materials of construction and one or more anatomical features included as part of the first member 10. As such, the first member 10 is not necessarily limited to any particular maximum weight. However, in an embodiment of the first member 10 configured for archery use the first member 10 suitably has a total weight light enough for the first member 10 to be manually lifted and/or transported by one or two persons. For example, the grizzly bear styled first member 10 of FIG. 18 including a first body section 45 constructed from extruded closed cell polystyrene foam and a second body section 47 comprising a polyurea spray coating and the dimensions as listed in Table 1 may have a total weight ranging from or about 1.4 kilograms (3.0 pounds) up to or about 3.2 kilograms (7.0 pounds). For purposes of manual lifting and/or transport, a first member 10 as shown in FIG. 18 suitably includes a maximum weight of 2.04 kilograms (4.5 pounds) and a first member 10 as shown in FIG. 20 suitably includes a maximum weight of 2.04 kilograms (4.5 pounds).

The one or more materials of construction of the first body section 45 and one or more rear surface items may be formed or shaped as desired. In one embodiment, a first member 10 may be provided as a one-piece material cut down to an intended shape and size including cutting out one or more openings 17, e.g., a naked first body section 45 provided without the inclusion of a second body section 47. Without limiting the invention, one exemplary first member 10 and corresponding one or more rear surface items may be constructed from a solid board type material and shaped to size via one or more cutting instruments, e.g., via one or more of a CNC machine, a laser, a water jet cutter, a saw blade, a knife, a razor blade, scissors. Although the first body section 45 may be built to scale, a one-piece board type material for forming a first body section 45 representing a life size game animal may include the following dimensions: (1) 243.8×121.9×5.1 cm (96.0×48.0×2.0 inches); (2) 243.8×121.9×10.2 cm (96.0×48.0×4.0 inches).

Figure 26:
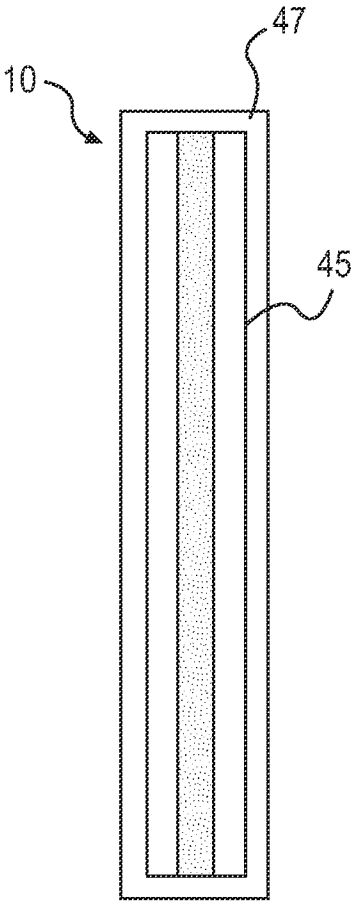
FIG. 26 is a cross-sectional side view of an embodiment of a first member of the present disclosure.
Figure 25:
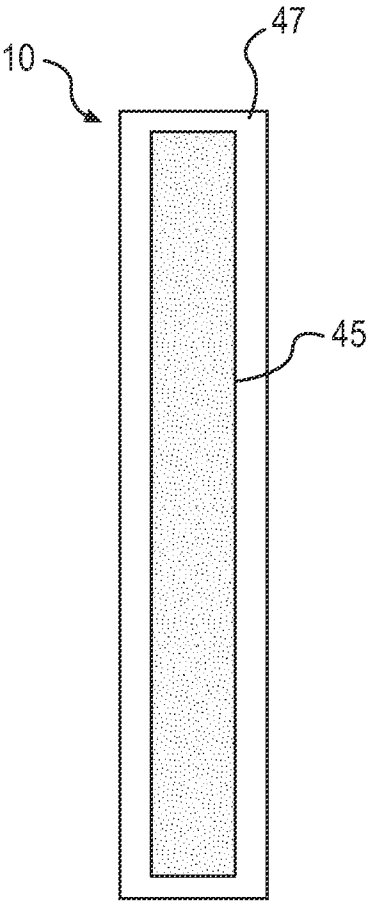
FIG. 25 is a cross-sectional side view of an embodiment of a first member of the present disclosure.
Figure 24:
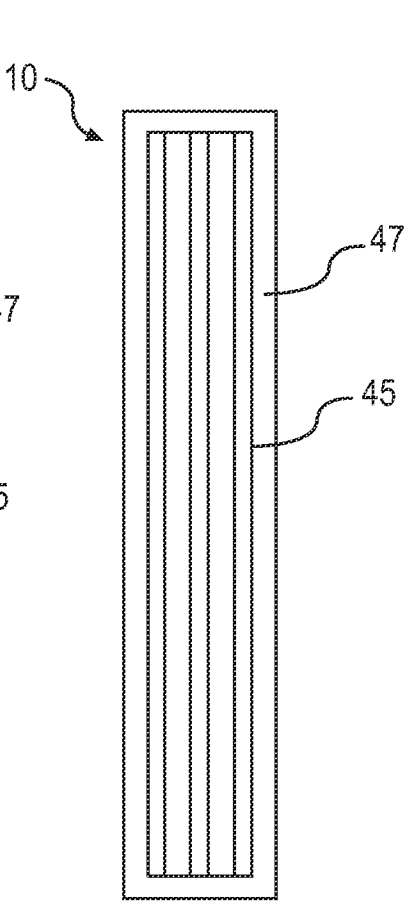
FIG. 24 is a cross-sectional side view of an embodiment of a first member of the present disclosure.
Figure 23:
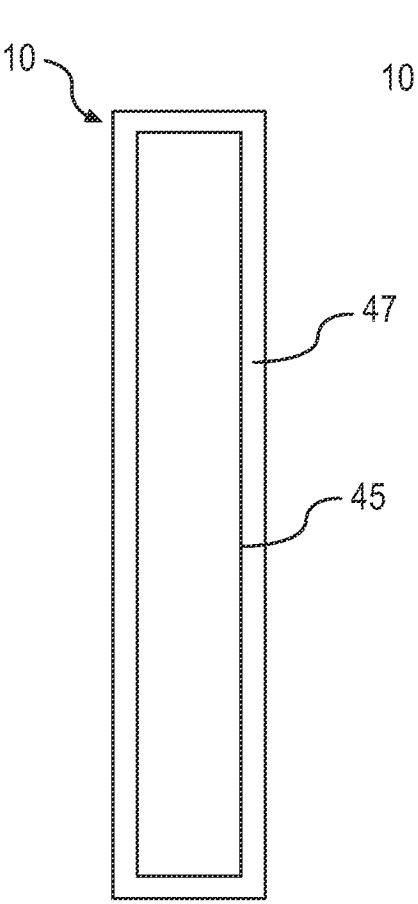
FIG. 23 is a cross-sectional side view of an embodiment of a first member of the present disclosure.
Figure 27:
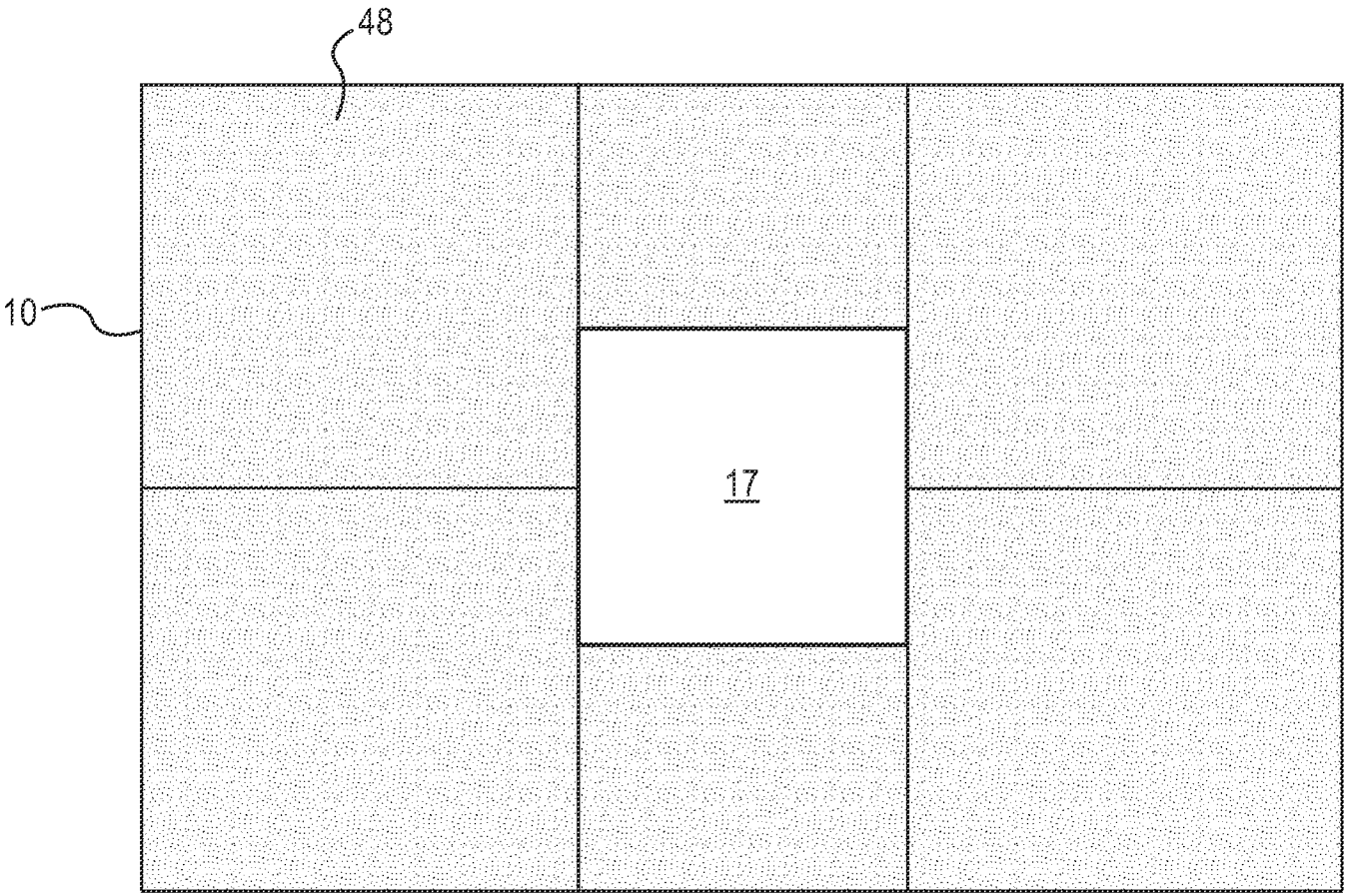
FIG. 27 is a front elevational view of an embodiment of a first member of the present disclosure.

As shown in FIG. 23, a naked one-piece first body section 45 may be covered with an outer second body section 47 to form a first member 10. In another embodiment, the first body section 45 may be constructed of two or more layers or sheets of solid material covered by a second body section 47 as shown in the simplified illustration of FIG. 24. Such layers may be oriented in simple abutment and/or adhered together. Also, the layers may be stacked ninety-degrees relative the arrangement of layers as shown in FIG. 24. In another embodiment, the first body section 45 may include a mixture of materials encased within a second body section 47 as shown in the simplified illustration of FIG. 25. In another embodiment, the first body section 45 may include a combination of solid layered material and a mixture of materials encased within a second body section 47 as shown in the simplified illustration of FIG. 26. In another embodiment, the first body section 45 and one or more openings 17 may be formed from a plurality of smaller sectional members 48 as shown in FIG. 27. In one embodiment, smaller sectional members 48 may be adhered together, fastened together, taped together, and combinations thereof. In the alternative, the smaller sectional members 48 may be held in an operable orientation via a second body section 47 covering the smaller sectional members 48.

In another embodiment, the first member 10 may be formed via a particular size and shape mold using one or more materials as described above. For example, a first member 10 may be formed via foam injection molding. In another embodiment, a first member 10 may be formed by pouring a flowable fluid comprising one or more of the above described materials into a mold of a desired size and shape for curing. As such, a suitable flowable fluid may also comprise one or more filler materials, one or more resins, one or more epoxies, and combinations thereof providing a solid member for use as part of the present system.

With reference to FIGS. 15, 19 and 21, the second body section 47 may further cover the frame type member 24, the one or more backing members 35 and one or more stake holders 25 in a manner effective to maintain each in a fixed operable position as part of the first member 10. In an embodiment where the second body section 47 includes a hand brush and/or spray coating, e.g., a polyurethane spray coating, polyurea spray coating, polyurethane-urea hybrid spray coating, the second body section 47 may include a continuous thickness or substantially continuous thickness covering the first body section 45. In another embodiment, the second body section 47 may include an increased thickness or greater thickness in the areas along the outer perimeter of the first body section 45 and the frame type member 24 and/or the one or more backing members 35 and/or the one or more stake holders 25 at a junction with the first body section 45 to increase the strength of attachment and/or structural strength of the frame type member 24 and/or the one or more backing members 35 and/or the one or more stake holders 25 for securing each to one another where applicable and for securing each to the first body section 45. For example, where the average thickness of the second body section 47 is 0.32 cm (0.125 inches or ⅛ inches) as described above, additional coating material may be added or disposed along the perimeter of the frame type member 24 and/or the one or more backing members 35 and/or the one or more stake holders 25 at a junction with the first body section 45 whereby the average thickness of the second body section 47 in such areas may be increased to or about 0.48 cm (0.19 inches or 3⁄16 inches).

Figure 28:
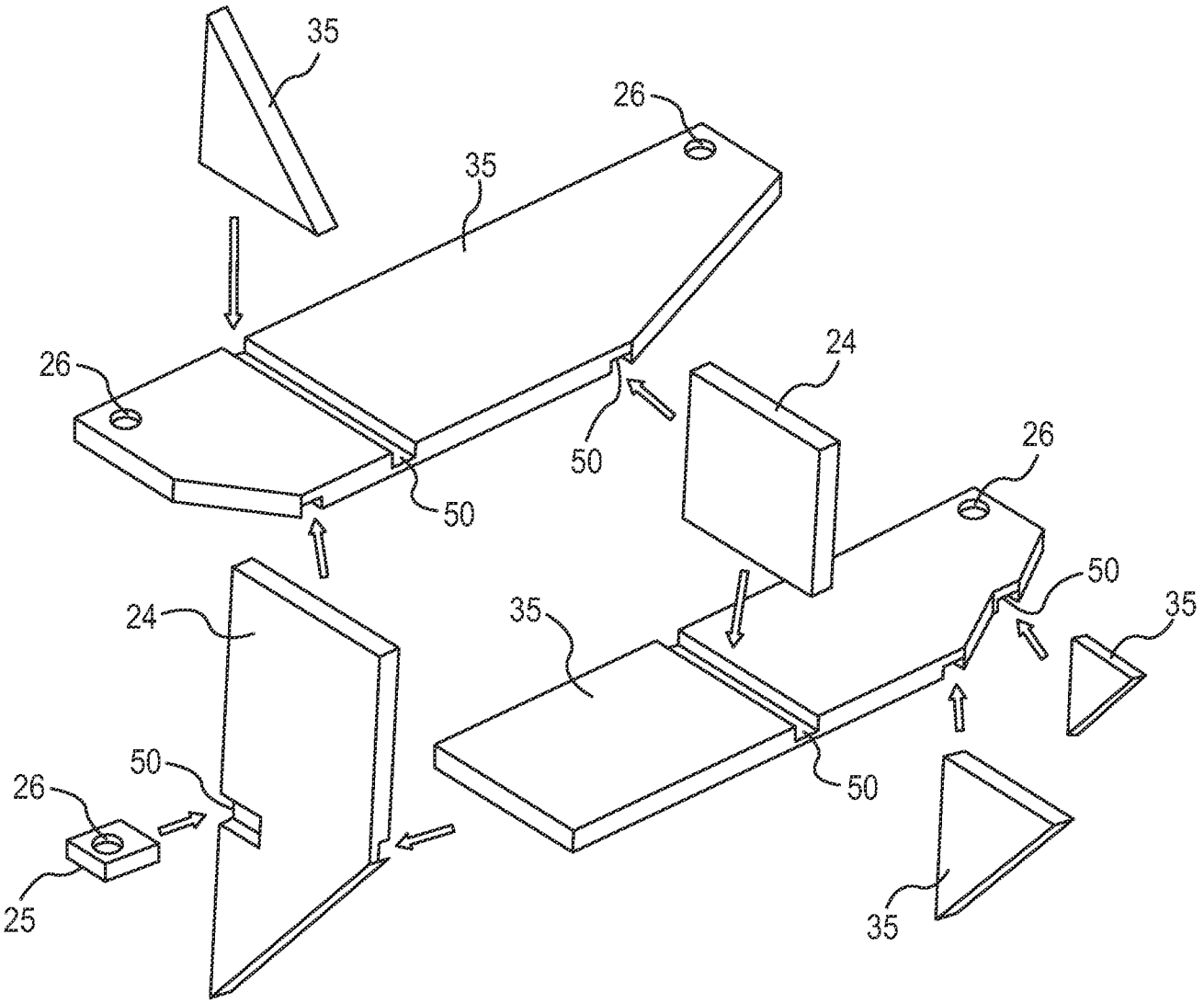
FIG. 28 is an exploded perspective view of rear side members of an embodiment of a first member of the present disclosure.
Figure 29:
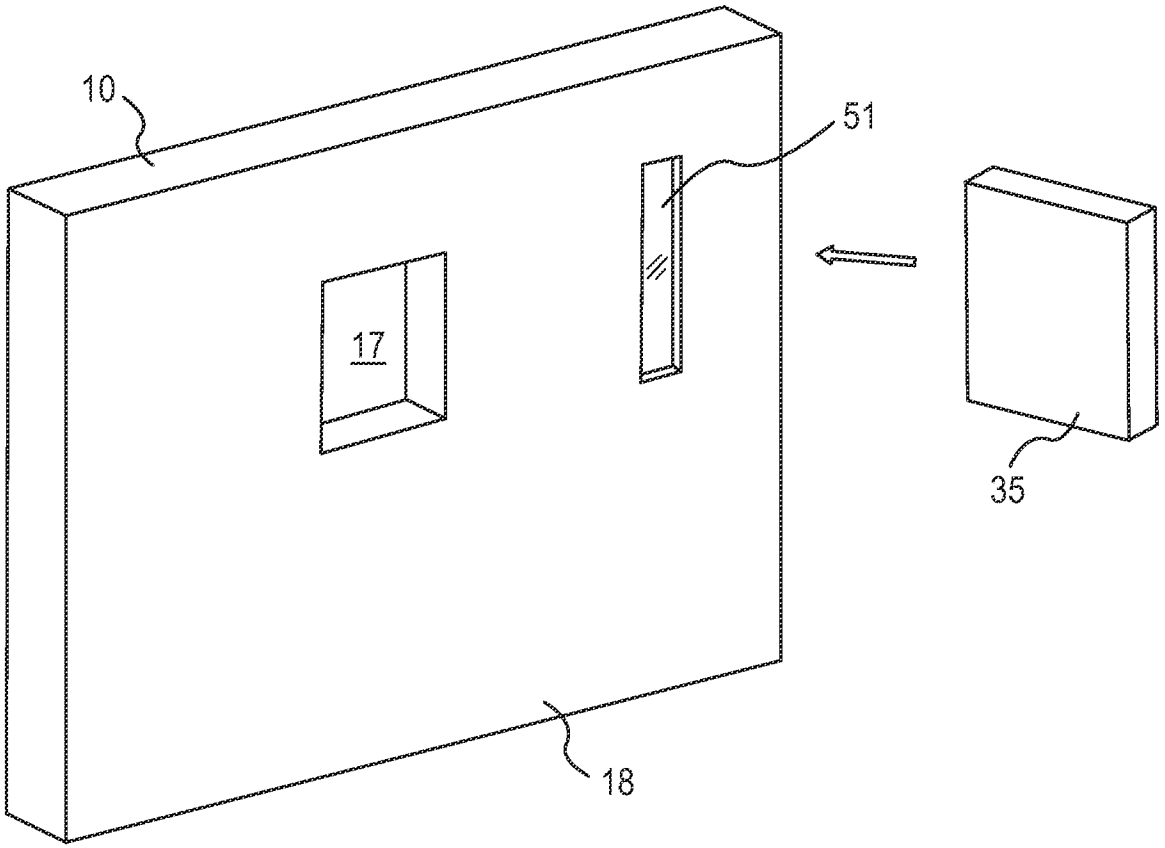
FIG. 29 is a rear perspective view of an embodiment of a first member and a corresponding backing member of the present disclosure.

In one embodiment, the frame type member 24, one or more backing members 35 and one or more stake holders 25 may be provided as separate component parts and assembled along the rear surface 18. In one implementation, assembly may include abutment of at least part of the frame type member 24 with one or more backing members 35 and/or abutment of two or more backing members 35 and/or and one or more stake holders 25 whereby the second body section 47 covers the frame type member 24, one or more backing members 35 and one or more stake holders 25 in a manner effective to hold each in a fixed position for use as part of the first member 10. With reference to FIG. 28, in another implementation a frame type member 24 and/or one or more backing members 35 and/or one or more stake holders 25 may include grooves 50, slots, channels, notches, and combinations thereof providing attachment type mating surfaces for assembly of the frame type member 24 and/or one or more backing members 35 and/or one or more stake holders 25. In another embodiment, the rear surface 18 of the first body section 45 may include one or more cutout sections 51 or cavities operable as female type mating surfaces at a desired depth or depths in the first body section 45 operationally configured to receive at least part of a corresponding frame type member 24 and/or one or more backing members 35 and/or one or more stake holders 25 therein—see FIG. 29. As understood by the skilled artisan, one or more cutout sections 51 may correspond in perimeter size and shape as one or more of the frame type member 24 and/or one or more backing members 35 and/or one or more stake holders 25.

In another implementation, assembly may include fastening part of the frame type member 24 to part of one or more of the backing members 35 and/or one or more stake holders 25 and/or fastening two or more backing members 35 together and/or fastening one or more backing members 35 to one or more stake holders 25 via one or more fasteners, e.g., screws, rods, bolts/nuts, and combinations thereof. In another implementation and depending on the materials of construction used, assembly may include adhering part of the frame type member 24 to one or more backing member 35 and/or adhering two or more backing members 35 together via heat, e.g., a heat gun, torch. In another implementation, assembly may include adhering part of the frame type member 24 to one or more backing members 35 and/or one or more stake holders 25 and/or adhering two or more backing members 35 together and/or adhering one or more backing members to one or more stake holders 25 via one or more adhesives, e.g., glue, epoxy, paste, and combinations thereof. In another implementation, a threaded stitch and/or tape may be used to attach one or more of the frame type member 24, one or more of the backing members 35 and/or one or more stake holders 25. In another embodiment, a frame type member 24 and backing members 35 as shown, for example, in FIG. 21 may be provided as a one-piece construction to be assembled with the first body section 45.

Figure 30:
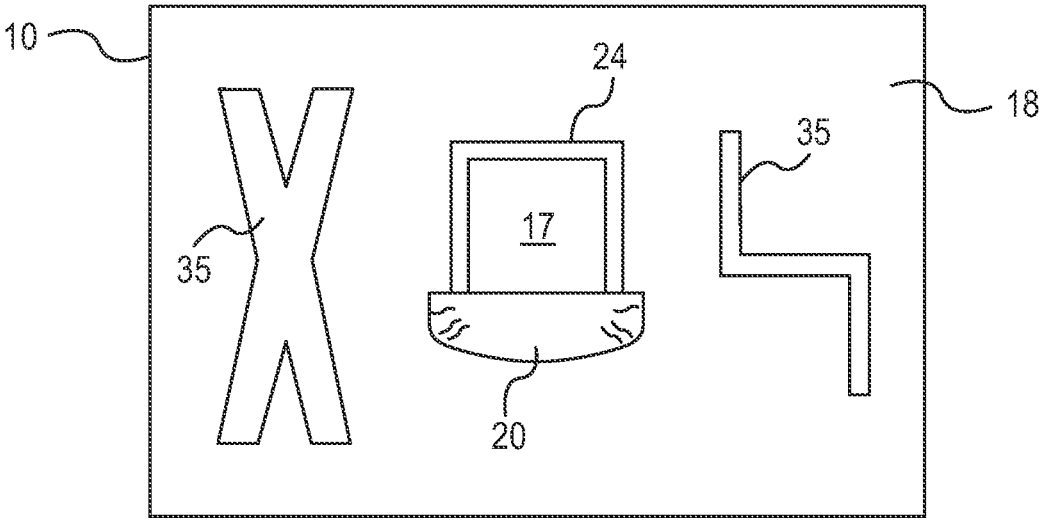
FIG. 30 is a rear elevational view of an embodiment of a first member of the present disclosure.
Figure 31:
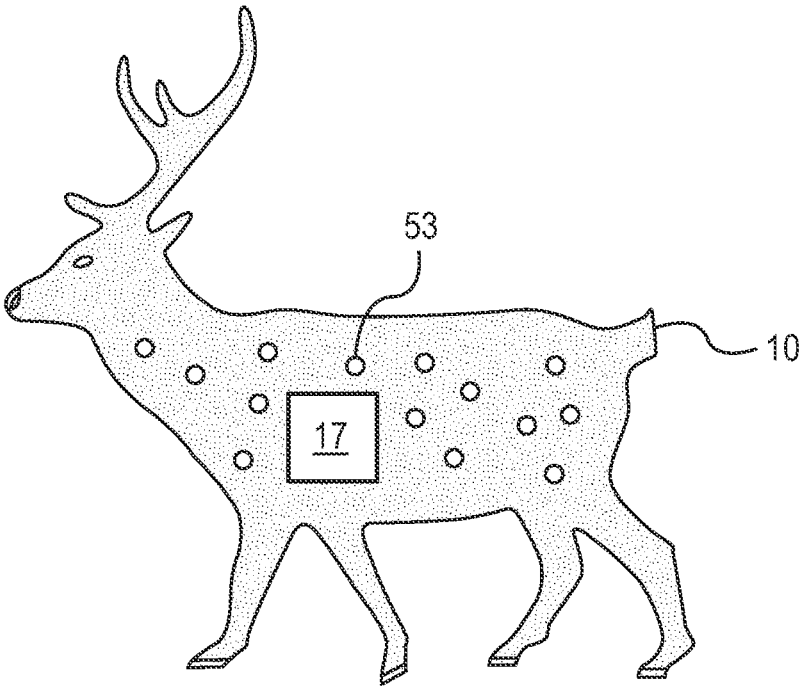
FIG. 31 is a front elevational view of an embodiment of a first member of the present application provided in the appearance of a standing deer.

As shown in the various figures as described above, the support member 20, frame type member 24, backing members 35 and stake holders 25 are provided as elongated rectangular members, e.g., plank type members, board type members, sheet type members. In another embodiment, the support member 20 and/or backing members 35 and/or stake holder 25 may be provided in other three-dimensional configurations, including rounded surfaces as shown in FIG. 30. In yet another embodiment as shown in FIG. 31, a first member 10 may include one or more apertures 53 operationally configured for the passage of wind there through in a manner effective to reduce wind forces upon the first member 10 during operation. In one embodiment, a first member 10 may include apertures of a similar shape and/or size. As understood by the skilled artisan, the number and size of the apertures 53 may vary. Also, the apertures 53 may be provided in a uniform pattern or in a non-uniform pattern as shown in FIG. 31.

A discussion concerning the manufacture of one non-limiting embodiment of a first member 10 is presented below. The skilled artisan will appreciate that the details described below may be considered as part of the manufacturing process of a first member 10 generally, regardless of the size, shape and appearance of the first member 10. For demonstrative purposes, manufacture of a first member 10 is described below in relation to manufacture of a first member 10 for archery use provided as a life size game animal in the shape and appearance of a grizzly bear as shown in FIG. 18.

Choice of Materials of the First Body Section 45 of the First Member 10

The material of construction for the first body section 45 of the first member 10 includes a sheet of closed cell extruded polystyrene foam with an RSI value of 0.88 (R-value of 5.0). The sheet of closed cell extruded polystyrene foam or "XPS" is provided in the following dimensions:

Centimeters: 243.8×121.9×5.1

Inches: 96.0×48.0×2.0.

One suitable commercially available XPS includes Styrofoam® Insulation Blue Board from The Dow Chemical Company, Midland, Michigan, U.S.A. ("Dow"). For archery type operations, closed cell XPS provides one or more of the following qualities: (1) XPS has a density strong enough to withstand the manufacturing process including handling and shape forming of the first member 10; (2) heat resistance; (3) water resistance; (4) XPS has the ability to maintain or hold its shape over extended periods of time making it suitable for shaping into a plurality of silhouette forms including the forms depicted as part of this disclosure; (5) XPS cuts fairly easy making it suitable for shaping into a plurality of silhouette forms; and (6) XPS maintains its integrity without material breakdown when applying a second body section 47 including a hand brush coating and/or spray coating as described above.

Forming the Perimeter Shape or Silhouette of the First Member 10

Once a desired game animal shape or silhouette is chosen, e.g., a grizzly bear form, an outlay design of a desired grizzly bear form is prepared e.g., drafted on paper via a hand drawing and/or via a computer drawing. Once a desired grizzly bear outlay design is completed, one or more additional details to be included along the front surface 15 of the first member 10 may be determined as well as the size, shape and location of the one or more openings 17 in accordance with the location of vital organs of the grizzly bear based on the outlay design. Thereafter, the size, shape, type and location of rear surface items such as a ledge type member 21, frame type member 24 including the backing members 35, and one or more stake holders 25 are determined for use along the rear surface 18 of the first body section 45 in accordance with (1) the size or surface area and shape of the rear surface 18 of the first body section 45, (2) the size, shape and location of the one or more openings 17, (3) the amount of backing structural support needed for operation of the first member 10, and (4) the amount of support needed by the support member 20.

Once the grizzly bear outlay design and corresponding parts are determined, a sheet of XPS can be readied for forming into the grizzly bear outlay design on a life size scale. First, the computer drawings and/or hand drawings of the grizzly bear outlay design are converted into computer files, e.g., .dxf files, readable by a CNC router machine operationally configured to cut along three axes (Z, Y and Z). One non-limiting example of a commercially available CNC router machine includes the G3 Digital Cutter commercially available from Zünd Systemtechnik AG, Altstätten, Switzerland. As understood by the skilled artisan, original computer drawings may be uploaded directly to a CNC router machine. As also understood by the skilled artisan, .dxf files suitably provide the CNC router machine with information concerning where the CNC router machine will enter the XPS material, the path the CNC router machine will follow and the depth of the router bit within the XPS material during operation. In one suitable mode of operation, the CNC router machine begins the cutting process by cutting or otherwise forming the perimeter silhouette of the grizzly bear and the opening 17. Thereafter, the CNC router machine routes out any front surface 15 details as programmed. For example, the CNC router machine may route out one or more anatomical features of the grizzly bear. Also, the CNC router machine may form one or more depressions or cavities in the front surface 15 for receiving eyes, claws and teeth therein.

For purposes of forming a life size game animal silhouette such as a grizzly bear, a CNC router machine is effective in that it achieves smooth cuts in the XPS material and is capable of routing intricate details on the front surface 15 of the first member 10. Persons of ordinary skill in the art will appreciate that even though a life size game animal silhouette may be formed by hand using one or more cutting instruments, such a task may be time consuming and physically exhausting.

Another advantage to using a sheet of XPS with the dimensions as described above to form a grizzly bear styled first member 10 as shown in FIGS. 18 and 19 is that the support member 20, frame type member 24, the backing members 35 and the stake holders 25 may be formed from the same sheet of XPS as the first body section 45, thereby, minimizing material costs. As such, computer software may be employed to best "nest" or place the various individual component parts making up the first member 10 along a sheet of XPS in a manner effective to best utilize the sheet of XPS. As understood by the skilled artisan, more than one sheet of XPS may be required for constructing a different embodiment of a first member 10.

Assembly of the First Member 10

Once the first body section 45, support member 20, frame type member 24, backing members 35 and stake holders 25 are cut out of a sheet of XPS, each is attached to the rear surface 18 of the first body section 45 via an adhesive, e.g., Loctite® PL300 adhesive commercially available from Henkel Corporation, Westlake, Ohio, U.S.A. The adhered component parts may be allowed to cure for about twenty-four hours.

Loctite® PL300 adhesive, or equivalent, is suitable for the following reasons: (1) Loctite® PL300 adhesive has desirable adhesive properties for use with foams including XPS, (2) Loctite® PL300 adhesive does not affect the material integrity of the XPS upon contact, (3) Loctite® PL300 adhesive's cure time is relatively short thereby minimizing the product time for the first member 10, (4) Loctite® PL300 adhesive is water soluble making it environmentally friendly and allowing for ease of clean up; and (5) Loctite® PL300 adhesive is recommended by Dow for use with their XPS products.

Addition of the Second Body Section 47 to the First Body Section 45

Once the Loctite® PL300 adhesive is cured, the first body member 10 is ready to receive its second body section 47 in the form of a polyurea elastomer spray ("spray coating") that is a reacted product of two components that are mixed and sprayed onto the first body section 45 in one or more passes. The first component (the "A" component) of the spray coating is UL XT 66, A-side and the second component (the "B" component) is UL XT 66, B-side, both of which are commercially available from Ultimate Linings, located in Houston, Texas, U.S.A.

UL XT 66, A-side (the "A" component) is comprised of:

(1) 37.0-61.0 percent Propanol [(1-methyl-1,2-ethanediyl)bis(oxy)] bis-polymer with 1,1'-methylenebis [isocyanateobenzene] and oxybis [propanol] with a CAS (Chemical Abstract Services) number of 0068092-58-0;

(2) 30.0-60.0 percent 4,4'-Methylenediphenyl Diisocyanate with a CAS number of 0000101-68-8;

(3) 4.0-10.0 percent Carbonic acid, cyclic propylene ester with a CAS 0000108-32-7; and has the properties as listed in Table 4:

TABLE 4

| | |
|---|---|
| VOC Regulatory | 0.00 kg (0.00 pounds); |
| Density | 1151.5 grams/liter (9.61 pounds/gallon); |
| Specific Gravity | 1.15; |
| Appearance | Clear Liquid; |
| Odor Description | Aromatic; |

TABLE 4-continued

| | |
|---|---|
| Water Solubility | Reacts with water; |
| Flash Point | 93.3° C. (200.0° F.); |
| Viscosity | 500.0-1000.0 millipascal-seconds (500.0-1000.0 centipoise); |
| Vapor Density | Heavier than air; |
| Low Boiling Point | 150.0° C. (302.0° F.); |
| Evaporation Rate | Slower than ether. |

UL XT 66, B-side (the "B" component) is comprised of:

(1) 10.0-24.0 percent Diethyltoluendediamine with a CAS number of 0068479-98-1;

(2) 3.0-7.0 percent Carbon Black with a CAS number of 0001333-86-4;

(3) 0.0-0.6 percent Silica, crystalline with a CAS 0014808-60-7.

The spray coating is suitable for use with XPS for the following reasons: (1) the spray coating adheres directly to the XPS forming a one-piece first member 10; (2) the spray coating adheres the various component parts to the first body section 45 together thereby enhancing the structural stability of the first member 10 during operation; (3) the spray coating is resistant to ultra-violet ("UV") radiation, i.e., "UV resistant," allowing the first member 10 to be exposed to direct sunlight for many years without structural degradation to the spray coating or fading in color; and (4) the spray coating does not affect the material integrity of the XPS upon contact with the XPS.

Another feature of the present disclosure is the system of equipment and process by which the spray coating is applied to the XPS. In order to effectively spray the spray coating, the system equipment is operationally configured to store, pump, heat, mix and spray the two components of the spray coating at a desired temperature, pressure, viscosity and material ratio. Control of such factors produces a desired first member 10 having a functionally desired second body section 47 for archery purposes.

In general, a volume of the "A" component and a volume of the "B" component are provided in separate fluid containers such as drums, tanks or the like and are mixed together during spraying operations as the "A" component and the "B" enter a spray gun at a desired temperature and volume to provide a homogeneous mixture exiting the spray gun. In particular, a fluid proportioner is provided having a first heated fluid conduit, e.g., a hose, in fluid communication with a first container housing the "A" component and a second heated fluid conduit, e.g., a hose, in fluid communication with a second container housing the "B" component. The first heated fluid conduit is operationally configured to condition the "A" component to a desired viscosity prior to mixing and the second heated fluid conduit is operationally configured to condition the "B" component to a desired viscosity prior to mixing. Said another way, the first heated fluid conduit and the second heated fluid conduit are each operationally configured to heat corresponding spray coating components and maintain the spray coating components at a desired temperature(s). In addition, a fluid proportioner is operationally configured to pressurize the spray coating components to a desired constant pressure while also maintaining an optimal ratio of the "A" and "B" components for mixing. One exemplary fluid proportioner for manufacture of the first member 10 may include the Graco® E-XP1 or the A-XP1 Reactor coatings proportioner commercially available from Graco Inc., Minneapolis, Minnesota, U.S.A. In addition, fluid proportioner operations are described in U.S. Pat. No. 9,221,669 B2, titled "Waste Heat Recovery System for Pumping System," issued Dec. 29, 2015; U.S. Pat. No. 8,568,104 B2, titled "Fast Set Material Proportioner," issued Oct. 29, 2013, each of which is hereby incorporated by reference in its entirety.

In operation, the pressure of the first and second fluid conduits is maintained at or about 16202.7 kPa (2350.0 PSI) and the internal temperature of the first and second heated fluid conduits, i.e., the temperature of the "A" component and the "B" component, are each maintained at a constant temperature of or about 68.3° C. (155.0° F.) as the two components enter a mixing chamber within the spray gun. Suitably, the "A" and "B" components are mixed at a 1:1 ratio at 68.3° C. (155.0° F.) within a mixing chamber of the spray gun producing an exothermic reaction that causes the temperature of the mixture to increase to a spray application temperature from or about 85.0° C. (185.0° F.) to or about 98.9° C. (210.0° F.). At pressures below or above 16202.7 kPa (2350.0 PSI), the "A" component and the "B" component will not properly mix resulting in poor or over atomization of the spray coating or lack atomization altogether. At temperatures less than 68.3° C. (155.0° F.), the reaction between the "A" component and the "B" component will not produce the desired polymerization of the spray coating. As such, at undesired pressures and temperatures, the resulting spray coating does not properly adhere to the surface of the XPS. Moreover, at temperatures greater than 98.9° C. (210.0° F.), the spray coating is hot enough to melt, deform and/or otherwise damage the integrity and appearance of the surface of the XPS upon contact. At temperatures less than 85.0° C. (185.0° F.), the spray coating is not hot enough to maintain a liquid form suitable for proper spraying of the spray coating onto the surface of the XPS. One non-limiting example of a commercially available spray gun for use as part of the present disclosure includes the FUSION® AP Spray Gun available from Graco Inc., Minneapolis, Minnesota, U.S.A. In addition, an exemplary spray gun is described in U.S. Pat. No. 7,694,893, titled "Plural Component Spray Gun for Fast Setting Materials," issued Apr. 13, 2010, which is hereby incorporated by reference in its entirety.

As understood by persons of ordinary skill in the art of fluid proportioners, the amount of time necessary to reach the desired spray temperature of 68.3° C. (155.0° F.) may vary based on the ambient temperature. For example, an ambient temperature of 15.6° C. (60.0° F.) will require a longer heating process than an ambient temperature of 32.2° C. (90.0° F.). A fluid proportioner, including the Graco E-XP1 or the A-XP1 Reactor coatings proportioner, is operationally configured to be programmed to heat the "A" component and the "B" component each to a desired temperature and provide a digital readout signaling to user(s) when the desired temperature of the "A" and "B" components is reached. As also understood by persons of ordinary skill in the art of fluid proportioners, a fluid proportioner, including the Graco E-XP1 or the A-XP1 Reactor coatings proportioner, is operationally configured to regulate the temperature and pressure of the "A" component and the "B" component via temperature and pressure controls, and is also operationally configured to monitor the mixture composition to ensure that the mixture undergoes a desired exothermic reaction. If the fluid proportioner detects that the temperature and/or pressure of either the "A" component or the "B" component is higher or lower than the programmed working temperature and pressure, the fluid proportioner is operationally configured to be directed to an OFF position to protect the component parts of the fluid proportioner and/or the spray gun from unwanted damage.

As understood by the skilled artisan, a second body section 47 in the form of a permanent polymer spray coating, e.g., polyurethane coatings, polyurea coatings, polyurethane-urea hybrid coatings, may be provided in a thickness according to the amount of spray coating that is applied to the first body section 45. As also understood by the skilled artisan, the thickness of the second body section 47 may affect its mechanical characteristics. Typically, the more passes made when applying the spray coating, the thicker the resulting second body section 47. In regard to the "A" component UL XT 66, A-side and the "B" component UL XT 66, B-side, suitable thicknesses of the second body section 47 may be formed according to the number of spray passes as described in Table 5:

TABLE 5

| Number of Spray Passes | Average Thickness of the Second Body Section 47 |
|---|---|
| 2 | 0.79 mm (0.0312 inches or 2/64 inches); |
| 3 | 1.19 mm (0.0469 inches or 3/64 inches); |
| 4 | 1.6 mm (0.0625 inches or 4/64 inches); |
| 5 | 1.98 mm (0.0781 inches or 5/64 inches). |

To form an effective second body section 47, the spray nozzle used is suitably held apart from the first body section 45 during each spray pass at a distance from or about 60.96 cm (24.0 inches) to or about 91.4 cm (36.0 inches).

In addition, the first body section 45 of the life size grizzly bear of FIG. 18 constructed from extruded closed cell polystyrene foam has a total weight of or about 2.3 kg (5.0 pounds). As a person of ordinary skill in the art will appreciate, the total weight of the first member 10 may vary according to the total volume of spray coating applied to the first body section 45. In view of Table 5, a first member 10 having a total of two (2) passes of spray coating has a total weight of or about 3.6 kg (8.0 pounds), meaning the second body section 47 comprises 37.5 percent of the total weight of the first member 10. A first member 10 having a total of five (5) passes of spray coating has a total weight of or about 5.7 kg (12.5 pounds), meaning the second body section 47 comprises 60.0 percent the total weight of the first member 10. Furthermore, the percentage may vary according to the materials of construction, shape and thickness of the first body section 45.

The spray coating described above suitably dries in about seven (7.0) seconds once the spray coating contacts the first body section 45. The dry time may vary depending on the ambient temperature and/or humidity. The spray coating suitably cools to room temperature and cures in a period of about two to three hours.

The spray coating may be formulated to include any color as desired. For example, a brown pigment or combination of pigments forming a brown color may be added to the spray coating to provide a brown colored second body section 45 as shown in FIG. 18. Suitable pigments for use herein include, but are not necessarily limited to urethane pigments (i.e., urethane colorants and dyes). Once the spray coating is applied to the first body section 45 one more additional colors may be added to the surface of the first member 10 via one or more mediums e.g., paint(s), dye(s), ink(s), and combinations thereof, to depict features of a grizzly bear thereon including changes in coloring, shadowing, depth, details regarding bear surface features (see FIG. 18).

First Member 10 Surface Finishing Details

By customizing the color of the spray coating of the first member 10, the total amount of surface mediums otherwise required to provide an accurate brownish color to the first member 10 is minimized or otherwise eliminated depending on the desired final surface appearance of the grizzly bear styled first member 10. As such, additional expense can be focused on the addition of one or more finishing details to the first member 10 as described above. Items such as hair, taxidermy eyes, taxidermy claws, and taxidermy teeth may be secured to the surface of the first member 10 via one or more adhesives, tapes, fasteners, and combinations thereof. For example, hair may be secured to the first member 10 via fasteners including, but not necessarily limited to staples, nylon sutures, and combinations thereof.

In another embodiment, a second body section 47 in the form of a polyurea elastomer spray ("spray coating") may be provided including an "A" component and a "B" component. The "A" component may be comprised of:

(1) 32.0-59.0 percent Polyurethane Prepolymer with a CAS (Chemical Abstract Services) number of 0068092-58-0;
(2) 31.0-57.0 percent 4,4'-Methylenediphenyl Diisocyanate with a CAS number of 0000101-68-8;
(3) 5.0-10.0 percent 4-Methyl-1,3-Dioxolan-2-one with a CAS 0000108-32-7; and has the properties as listed in Table 6:

TABLE 6

| | |
|---|---|
| VOC Regulatory | 0.00 kg (0.00 pounds); |
| Density | 1151.5 grams/liter (9.61 pounds/gallon); |
| Specific Gravity | 1.15; |
| Appearance | Clear Liquid; |
| Odor Description | Aromatic; |
| Water Solubility | Reacts with water; |
| Flash Point | 93.3° C. (200.0° F.); |
| Viscosity | 500.0-1000.0 millipascal-seconds (500.0-1000.0 centipoise); |
| Vapor Density | Heavier than air; |
| Low Boiling Point | 150.0° C. (302.0° F.); |
| Evaporation Rate | Slower than ether. |

The "B" component may be comprised of:

(1) 13.0-24.0 percent Aromatic Amine with a CAS number of 0068479-98-1;
(2) 4.0-7.0 percent Carbon Black with a CAS number of 0001333-86-4;
(3) 5.0-10.0 percent 4-Methyl-1,3-Dioxolan-2-one with a CAS 0000108-32-7.

Although the present disclosure describes various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments, whether or not such embodiments are described and whether or not such features are presented as being a part of a described embodiment. Thus, the breadth and scope of the claimed invention should not be limited by any of the above-described embodiments.

Terms and phrases used in this disclosure, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard,"

"known" and terms of similar meaning should not be construed as limiting the item described to a given time period or to an item available as of a given time.

The presence of broadening words and phrases such as "one or more," "at least," "but not limited to" or other like phrases in some instances shall not be read to mean that the narrower case is intended or required in instances where such broadening phrases might be absent. The use of the term "assembly" does not imply that the components or functionality described or claimed as part of the module are all configured in a common package.

Persons of ordinary skill in the art will recognize that many modifications may be made to the present disclosure and the embodiment(s) described herein are meant to be illustrative only and should not be taken as limiting the invention, which is defined in the claims.

We claim:

1. A process for manufacturing a support for a projectile target, the process comprising the steps of:

forming component parts of the support from a three-dimensional single sheet of closed cell extruded polystyrene foam, the component parts formed including: (1) an upright first body having (a) a selected perimeter shape and size defining a height of the support; (b) a front surface; (c) a rear surface; and (d) an opening there through at a selected location on the upright first body, the opening having a selected size and shape; and (2) one or more rear side members to be disposed along the rear surface of the upright first body, each of the one or more rear side members having a selected size and shape;

assembling the one or more rear side members to the rear surface of the upright first body at one or more locations according to the perimeter shape and size of the upright first body, the size and shape of the one or more rear side members, and according to the size, shape and selected location of the opening; and applying one or more coatings onto the assembly of the upright first body and the one or more rear side members at an average thickness effective to maintain the one or more rear side members in a fixed position with the upright first body once the one or more coatings cure.

2. The process of claim 1, wherein in the forming step the three-dimensional single sheet of closed cell extruded polystyrene foam has an R-value of 5.0 and wherein the applying step comprises applying one or more spray coatings onto the assembly of the upright first body and the one or more rear side members at a spray application temperature from or about 185.0° F. to or about 210.0° F.

3. The process of claim 1, wherein the forming step includes designating a first part of the three-dimensional single sheet of closed cell extruded polystyrene foam for forming the upright first body and designating a remaining part of the three-dimensional single sheet of closed cell extruded polystyrene foam for forming the one or more rear side members according to the dimensions of the three-dimensional single sheet of closed cell extruded polystyrene foam, the perimeter shape and size of the upright first body, and the size and shape of the one or more rear side members.

4. The process of claim 1, wherein the forming step includes forming the opening of the upright first body to include a selected height and width and forming at least one rear side member of the one or more rear side members to include a length greater than the height and width of the opening.

5. The process of claim 1, wherein the assembling step includes assembling the one or more rear side members onto the rear surface of the upright first body at one or more locations effective to hold the projectile target at the opening of the upright first body once the one or more coatings cure.

6. The process of claim 1, wherein the assembling step includes attaching the one or more rear side members to the rear surface of the upright first body via adhesive.

7. The process of claim 1, wherein the applying step comprises applying one or more spray coatings onto the assembly of the upright first body and the one or more rear side members, the one or more spray coatings comprising a reacted product of two components including a first component comprising 37.0-61.0 percent Propanol [(1-methyl-1,2-ethanediyl)bis(oxy)] bis-polymer with 1,1'-methylenebis [isocyanateobenzene] and oxybis [propanol], 30.0-60.0 percent 4,4'-Methylenediphenyl Diisocyanate, and 4.0-10.0 percent Carbonic acid, cyclic propylene ester and a second component comprising 10.0-24.0 percent Diethyltoluendediamine, 3.0-7.0 percent Carbon Black, and 0.0-0.6 percent Silica, crystalline.

8. The process of claim 7, wherein the applying step includes mixing the first component and the second component at a 1:1 ratio and at a constant temperature of 155.0° F. within a mixing chamber of a spray gun producing an exothermic reaction causing the temperature of the mixture of the first component and the second component to increase to a spray application temperature from or about 185.0° F. to or about 210.0° F.

9. The process of claim 8, wherein the applying step includes applying the one or more spray coatings onto the assembly of the upright first body and the one or more rear side members via the spray gun in one or more passes at a spray distance from or about 24.0 inches to or about 36.0 inches.

10. The process of claim 1, wherein the applying step includes applying one or more spray coatings onto the assembly of the upright first body and the one or more rear side members, the one or more spray coatings comprising a reacted product of two components and a color pigment selected according to the selected perimeter shape of the upright first body.

11. The process of claim 1, wherein the forming step includes forming the upright first body and the one or more rear side members from the three-dimensional single sheet of closed cell extruded polystyrene foam using a CNC router machine programmed to cut the single sheet of closed cell extruded polystyrene foam along three axes to form the component parts of the support.

12. The process of claim 1, wherein the forming step includes forming an opening through at least one of the one or more rear side members.

13. A process for manufacturing a support for a projectile target, the process comprising the steps of:

forming individual component parts of the support from a single sheet of closed cell extruded polystyrene foam using a CNC router machine programmed to nest the individual component parts along the single sheet of closed cell extruded polystyrene foam and cut the single sheet of closed cell extruded polystyrene foam along three axes to form the individual component parts, the individual component parts including (1) an upright first body having (a) a selected perimeter shape and size defining a height of the support, (b) a front surface, (c) a rear surface, and (d) an opening there through at a selected location on the upright first body, the opening having a selected size and shape, and (2)

one or more rear side members to be disposed along the rear surface of the upright first body, each of the one or more rear side members having a selected size and shape;

assembling the one or more rear side members to the rear surface of the upright first body at one or more locations according to the perimeter shape and size of the upright first body, the size and shape of the one or more rear side members, and according to the size, shape and selected location of the opening; and applying one or more coatings onto the assembly of the upright first body and the one or more rear side members at an average thickness effective to maintain the one or more rear side members in a fixed position with the upright first body once the one or more coatings cure.

14. The process of claim 13, wherein the forming step further includes using the CNC router machine to route out one or more finishing details on the front surface of the upright first body.

15. The process of claim 13, wherein the forming step includes forming the upright first body to include a perimeter shape and size of a game animal and further includes using the CNC router machine to route out one or more anatomical features of the game animal on the front surface of the upright first body.

16. The process of claim 15, wherein the forming step further includes using the CNC router machine to form one or more cavities in the front surface of the upright first body for receiving therein items selected from the group consisting of game animal eyes, claws, and teeth.

17. The process of claim 15, wherein the applying step includes:

applying one or more polymer spray coatings comprising a color pigment onto the assembly of the upright first body and the one or more rear side members via a spray gun at a spray application temperature from or about 185.0° F. to or about 210.0° F., wherein the color pigment is selected according to the game animal formed from the upright first body; and applying the spray coating onto the assembly of the upright first body and the one or more rear side members via the spray gun in one or more passes at a spray distance from or about 24.0 inches to or about 36.0 inches.

18. The process of claim 17, wherein the applying step includes:

applying one or more polymer spray coatings comprising a urethane colorant onto the assembly of the upright first body and the one or more rear side members; and applying one or more colors to a part of the one or more polymer spray coatings covering the upright first body via one or more mediums selected from the group consisting of paints, dyes, inks, and combinations thereof, to depict features of the game animal including changes in coloring, shadowing, and depth.

19. The process of claim 13, wherein in the forming step the single sheet of closed cell extruded polystyrene foam has an R-value of 5.0 and dimensions of 96.0 inches×48.0 inches×2.0 inches and the upright first body is formed to include a perimeter shape and size of a game animal, and wherein the applying step includes applying one or more polymer spray coatings onto the assembly of the upright first body and the one or more rear side members using a spray gun at a spray application temperature from or about 185.0° F. to or about 210.0° F.

20. The process of claim 15, wherein in the forming step the selected location of the opening corresponds to a location of one or more vital organs of the game animal.

* * * * *